US009207627B2

(12) United States Patent
Souda et al.

(10) Patent No.: US 9,207,627 B2
(45) Date of Patent: Dec. 8, 2015

(54) FRAME-ENHANCING STRUCTURE FOR A FRAME TO SUPPORT AN IMAGE FORMING UNIT IN AN IMAGE FORMING APPARATUS

(71) Applicant: Brother Kogyo Kabushiki Kaisha, Nagoya-shi, Aichi-ken (JP)

(72) Inventors: Makoto Souda, Nagoya (JP); Yohei Nishimura, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/305,046

(22) Filed: Jun. 16, 2014

(65) Prior Publication Data

US 2014/0376957 A1 Dec. 25, 2014

(30) Foreign Application Priority Data

Jun. 20, 2013 (JP) ..... 2013-129802
Nov. 29, 2013 (JP) ..... 2013-248241

(51) Int. Cl.
*G03G 21/16* (2006.01)
*G03G 21/18* (2006.01)

(52) U.S. Cl.
CPC ..... *G03G 21/1619* (2013.01); *G03G 21/1842* (2013.01); *G03G 21/1853* (2013.01); *G03G 2215/0141* (2013.01); *G03G 2221/1684* (2013.01)

(58) Field of Classification Search
CPC .. G03G 21/1619; G03G 2221/1678–2221/169
USPC ..... 399/107; 206/316.1
See application file for complete search history.

(56) References Cited

U.S. PATENT DOCUMENTS 4,903,452 A * 2/1990 Huang ..... 52/646
5,208,612 A * 5/1993 Obu et al. ..... 347/152
6,069,646 A 5/2000 Okabe et al.
6,208,817 B1 * 3/2001 Chadani et al. ..... 399/104

(Continued)

FOREIGN PATENT DOCUMENTS

JP S55-3546 U 1/1980
JP H10-161507 A 6/1998

(Continued)

OTHER PUBLICATIONS

U.S. Appl. No. 14/541,910, filed Nov. 14, 2014.

(Continued)

*Primary Examiner* — Clayton E LaBalle
*Assistant Examiner* — Trevor J Bervik
(74) *Attorney, Agent, or Firm* — Banner & Witcoff, Ltd.

(57) ABSTRACT

An image forming apparatus, including an image forming unit comprising a photosensitive drum configured to be rotatable about a rotation axis and a developer device configured to supply a developer agent to the photosensitive drum; a first frame made of a resin and formed in a shape of a plate, while the first frame is arranged on one end, along an axial direction of the rotation axis of the photosensitive drum, of the image forming unit; and a first beam made of a metal and formed in an elongated shape, while the first beam is arranged along and fixed to a planar face of the first frame, is provided. The first beam is arranged to overlap the image forming unit at a longitudinal central part thereof, when projected along the axial direction, while longitudinal ends of the first beam are arranged on outer sides of the image forming unit.

31 Claims, 15 Drawing Sheets

(56) References Cited

U.S. PATENT DOCUMENTS

| | | | | |
|---|---|---|---|---|
| 7,567,769 | B2 | 7/2009 | Noguchi et al. | |
| 7,706,716 | B2 | 4/2010 | Tada et al. | |
| 7,783,226 | B2 | 8/2010 | Tomatsu | |
| 7,894,743 | B2 | 2/2011 | Tomatsu | |
| 8,175,491 | B2 | 5/2012 | Tomatsu et al. | |
| 8,244,153 | B2 | 8/2012 | Nakashima | |
| 8,428,486 | B2 | 4/2013 | Abe et al. | |
| 8,532,524 | B2 | 9/2013 | Souda | |
| 8,611,790 | B2 | 12/2013 | Souda | |
| 8,706,001 | B2 | 4/2014 | Yamauchi et al. | |
| 8,948,680 | B2 | 2/2015 | Nishimura | |
| 2003/0177999 | A1 | 9/2003 | Saito et al. | |
| 2007/0160382 | A1 | 7/2007 | Tomatsu | |
| 2008/0075502 | A1 | 3/2008 | Tada et al. | |
| 2008/0159773 | A1 | 7/2008 | Murayama et al. | |
| 2008/0159781 | A1 | 7/2008 | Noguchi et al. | |
| 2010/0014887 | A1 | 1/2010 | Tomatsu et al. | |
| 2010/0080612 | A1 | 4/2010 | Nakashima | |
| 2010/0135689 | A1 | 6/2010 | Abe et al. | |
| 2011/0102983 | A1 | 5/2011 | Souda et al. | |
| 2011/0129276 | A1 | 6/2011 | Kondo | |
| 2011/0170932 | A1* | 7/2011 | Bhatia et al. | 400/679 |
| 2011/0262173 | A1 | 10/2011 | Souda | |
| 2012/0038091 | A1* | 2/2012 | Tagawa | 267/136 |
| 2013/0004198 | A1 | 1/2013 | Tomatsu | |
| 2013/0004199 | A1* | 1/2013 | Souda et al. | 399/110 |
| 2013/0077990 | A1 | 3/2013 | Nakashima | |
| 2013/0170857 | A1 | 7/2013 | Souda et al. | |
| 2014/0376943 | A1 | 12/2014 | Nishimura | |
| 2014/0376944 | A1 | 12/2014 | Souda et al. | |
| 2014/0376945 | A1 | 12/2014 | Souda et al. | |
| 2014/0376946 | A1 | 12/2014 | Souda et al. | |
| 2014/0376958 | A1 | 12/2014 | Souda et al. | |

FOREIGN PATENT DOCUMENTS

| | | | |
|---|---|---|---|
| JP | 2000-177202 | A | 6/2000 |
| JP | 2000-352921 | A | 12/2000 |
| JP | 2003-278739 | A | 10/2003 |
| JP | 2003-343541 | A | 12/2003 |
| JP | 2004-068862 | A | 3/2004 |
| JP | 2004-151510 | A | 5/2004 |
| JP | 2005-037652 | A | 2/2005 |
| JP | 2006-239876 | A | 9/2006 |
| JP | 2007-148142 | A | 6/2007 |
| JP | 2008-065122 | A | 3/2008 |
| JP | 2008-165027 | A | 7/2008 |
| JP | 2010-026152 | A | 2/2010 |
| JP | 2010-044363 | A | 2/2010 |
| JP | 2010-079046 | A | 4/2010 |
| JP | 2010-128337 | A | 6/2010 |
| JP | 2011-232513 | A | 11/2011 |
| JP | 2013-137426 | A | 7/2013 |

OTHER PUBLICATIONS

U.S. Appl. No. 14/582,753, filed Dec. 24, 2014.
U.S. Appl. No. 14/582,630, filed Dec. 24, 2014.
U.S. Appl. No. 14/582,715, filed Dec. 24, 2014.
U.S. Appl. No. 14/582,720, filed Dec. 24, 2014.
Feb. 18, 2015—(US) Notice of Allowance—U.S. Appl. No. 14/305,351.
Mar. 5, 2015—(US) Notice of Allowance—U.S. Appl. No. 14/305,093.
Apr. 13, 2015—(US) Non-Final Office Action—U.S. Appl. No. 14/305,040.
Apr. 9, 2015—(US) Non-Final Office Action—U.S. Appl. No. 14/305,083.
Apr. 13, 2015—(US) Ex Parte Quayle Office Action—U.S. Appl. No. 14/305,068.
Aug. 5, 2015—(US) Notice of Allowance—U.S. Appl. No. 14/541,910.
Sep. 3, 2015—(US) Notice of Allowance—U.S. Appl. No. 14/305,068.
Jun. 11, 2015—(US) Ex Parte Quayle Office Action—U.S. Appl. No. 14/582,753.
Jun. 26, 2015—(US) Notice of Allowance—U.S. Appl. No. 14/541,910.
Jul. 2, 2015—(US) Non-Final Office Action—U.S. Appl. No. 14/582,630.

* cited by examiner

FRAME-ENHANCING STRUCTURE FOR A FRAME TO SUPPORT AN IMAGE FORMING UNIT IN AN IMAGE FORMING APPARATUS

CROSS REFERENCE TO RELATED APPLICATION

This application claims priority from Japanese Patent Application No. 2013-129802 filed on Jun. 20, 2013 and No. 2013-248241 filed on Nov. 29, 2013, the entire subject matter of which is incorporated herein by reference.

BACKGROUND

1. Technical Field

An aspect of the present invention relates to an image forming apparatus having a resin frame, which is configured to support an image forming unit having a photosensitive drum.

2. Related Art

An image forming apparatus having side frames, which are made of a metal with rigidity, to support an image forming unit laterally, is known. In the image forming apparatus, while the side frames arranged on lateral sides of the image forming may be made of a metal, resin frames may be coupled to lower ends of the metal frames.

SUMMARY

In the image forming apparatus with the above-mentioned frame structure with the metal-made side frames, a weight of the image forming apparatus may be increased. In this respect, in order to reduce the weight, resin-made side frames may be employed in place of the metal-made side frames. However, the side frame made of a resin may be less rigid compared to the metal frames.

The present invention is advantageous in that an image forming apparatus, in which rigidity of a frame arranged on one side of an image forming unit is increased while a weight of the image forming apparatus is prevented from being increased, is provided.

According to an aspect of the present invention, an image forming apparatus, including an image forming unit comprising a photosensitive drum configured to be rotatable about a rotation axis and a developer device configured to supply a developer agent to the photosensitive drum; a first frame made of a resin and formed in a shape of a plate, the first frame being arranged on one end, along an axial direction of the rotation axis of the photosensitive drum, of the image forming unit; and a first beam made of a metal and formed in an elongated shape, the first beam being arranged along and fixed to a planar face of the first frame, is provided. The first beam is arranged to overlap the image forming unit at a longitudinal central part thereof, when projected along the axial direction, while longitudinal ends of the first beam are arranged on outer sides of the image forming unit.

According to another aspect of the present invention, an image forming apparatus, including an image forming unit comprising a photosensitive drum configured to be rotatable about a rotation axis; a first frame made of a resin and arranged on one end, along an axial direction of the rotation axis of the photosensitive drum, of the image forming unit; a substrate arranged on one side of the first frame opposite from the image forming unit; a plurality of substrate supports arranged on the first frame and configured to support the substrate; a plurality of spring electrodes, each of which is arranged in a position between the substrate and the image forming unit in a compressed condition; and a first beam formed in an elongated shape having a shorter side and a longer side, the first beam being arranged along and fixed to a planar face on the one side of the first frame facing the substrate, is provided. The plurality of substrate supports comprise paired first supports, which are arranged to be spaced apart from each other. While a first virtual line is drawn through the paired first supports, a first intermediate spring electrode being a part of the plurality of spring electrodes is arranged in an intermediate area between two second virtual lines, each of which is drawn through one of the paired first supports orthogonally to the first virtual line when viewed along a facing direction to face the planar face of the first frame orthogonally. The first beam comprises a first attachment portion, at which the first beam is fixed to the first frame at least along the facing direction, and is arranged to intersect with the first virtual line when viewed along the facing direction.

According to another aspect of the present invention, an image forming apparatus, including an image forming unit comprising a photosensitive drum configured to be rotatable about a rotation axis; a first frame made of a resin and arranged on one end, along an axial direction of the rotation axis of the photosensitive drum, of the image forming unit; a substrate arranged to face the image forming unit; a plurality of substrate supports arranged on the first frame and configured to support the substrate; a plurality of spring electrodes arranged in positions between the substrate and the image forming unit; and a first beam formed in an elongated shape, the first beam being arranged along and fixed to a planar face of the first frame, is provided. When viewed along a direction orthogonal to the planar face of the first frame, the first beam, at least one of the spring electrodes, and at least one of the substrate supports are arranged to align along a direction orthogonal to a longitudinal direction of the first beam in an order: the first beam, the at least one of the spring electrodes, the at least one of the substrate supports.

According to another aspect of the present invention, an image forming apparatus, including an image forming unit comprising a photosensitive drum configured to be rotatable about a rotation axis; a first frame made of a resin and arranged on one end, along an axial direction of the rotation axis of the photosensitive drum, of the image forming unit; a substrate arranged on one side of the first frame opposite from the image forming unit; a plurality of substrate supports arranged on the first frame and configured to support the substrate; a plurality of spring electrodes, each of which is arranged in a position between the substrate and the image forming unit in a compressed condition; and a first beam formed in an elongated shape having a shorter side and a longer side, the first beam being arranged along and fixed to a planar face on the one side of the first frame facing the substrate, is provided. The plurality of substrate supports comprise paired substrate supports, which are arranged to be spaced apart from each other at least along a longitudinal direction of the first beam. While a first virtual line is drawn through the paired substrate supports, an intervening spring electrode being a part of the plurality of spring electrodes is arranged in an intermediate area between two second virtual lines, each of which is drawn through one of the paired substrate supports orthogonally to the first virtual line when viewed along the facing direction. The first beam is formed to extend outwardly along the longitudinal direction thereof beyond the paired substrate supports.

According to another aspect of the present invention, an image forming apparatus, including an image forming unit comprising a photosensitive drum configured to be rotatable about a rotation axis; a first frame made of a resin and arranged on one end, along an axial direction of the rotation axis of the photosensitive drum, of the image forming unit; a substrate arranged to face the image forming unit; a substrate support arranged on the first frame and configured to support the substrate; a spring electrode arranged in a position between the substrate and the image forming unit; and a first beam formed in an elongated shape, the first beam being arranged along and fixed to a planar face of the first frame, is provided. When viewed along a direction orthogonal to the planar face of the first frame, the first beam, the spring electrode, and the substrate support are arranged to align along a direction orthogonal to a longitudinal direction of the first beam in an order: the spring electrode, the first beam, the substrate support.

BRIEF DESCRIPTION OF THE ACCOMPANYING DRAWINGS

DETAILED DESCRIPTION

Hereinafter, a configuration of a color printer 1 according to an embodiment of the present invention will be described with reference to the accompanying drawings. First, an overall configuration of the color printer 1 will be described, and second, specific components in the color printer 1 will be described in detail.

Figure 1:
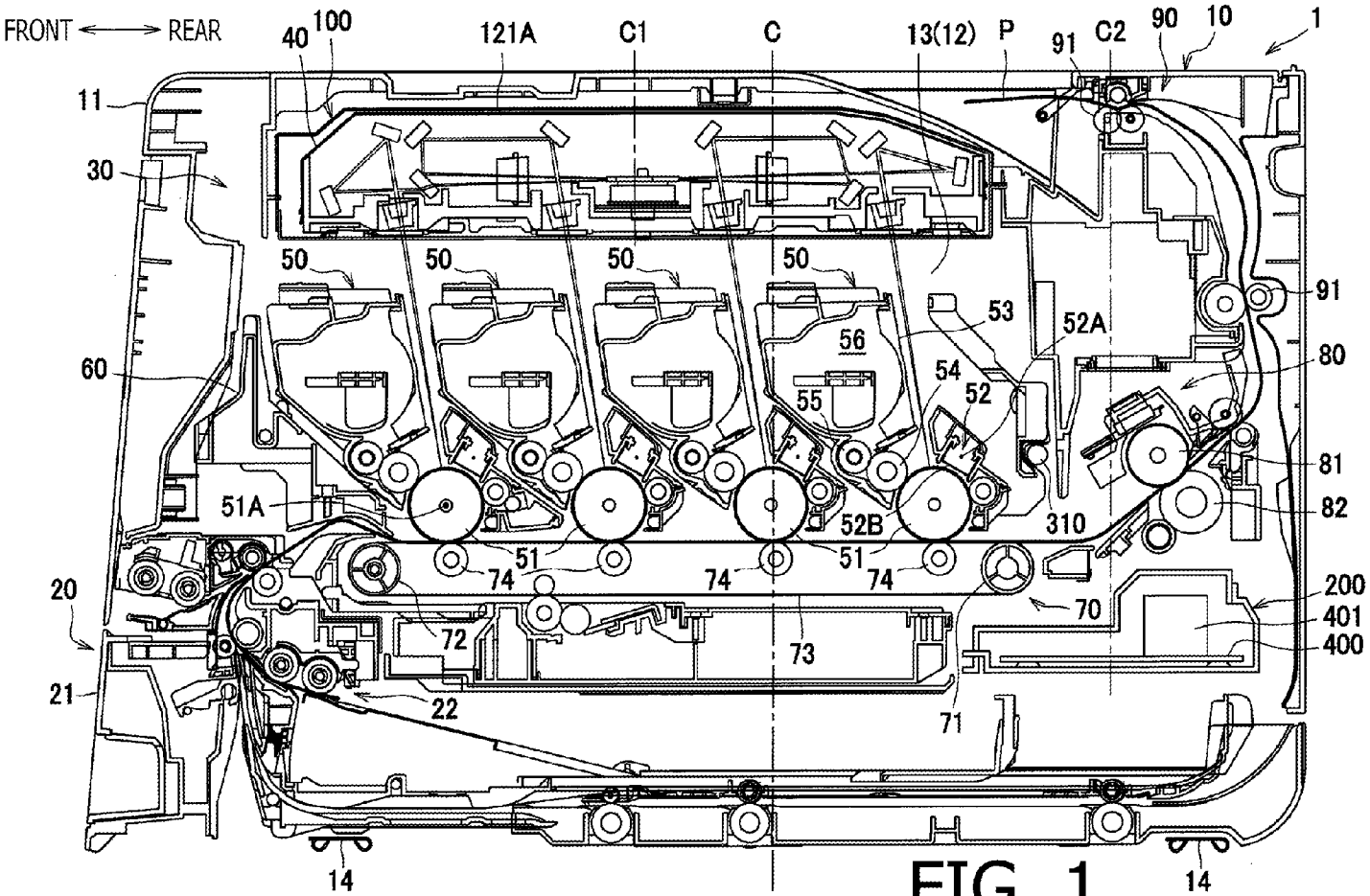
FIG. 1 is a cross-sectional side view of a color printer according to an embodiment of the present invention.

In the following description, directions concerning the color printer 1 will be referred to in accordance with orientation indicated by arrows in each drawing. Therefore, for example, a viewer's left-hand side appearing in FIG. 1 is referred to as a front side of the color printer 1, and a right-hand side in FIG. 1 opposite from the front side is referred to as a rear side. A side which corresponds to the viewer's nearer side is referred to as a right-hand side for a user, and an opposite side from the right, which corresponds to the viewer's farther side is referred to as a left-hand side for the user. An up-down direction in FIG. 1 corresponds to a vertical direction of the color printer 1. Further, the right-to-left or left-to-right direction of the color printer 1 may be referred to as a widthwise direction, and the front-to-rear or rear-to-front direction may be referred to as a direction of depth. The widthwise direction and the direction of depth are orthogonal to each other. Furthermore, directions of the drawings in FIGS. 2-15 are similarly based on the orientation of the color printer 1 as defined above and correspond to those with respect to the color printer 1 shown in FIG. 1 even when the drawings are viewed from different angles.

Overall Configuration of the Color Printer

The color printer 1 includes a feeder unit 20, an image forming unit 30, and an ejection unit 90, which are arranged inside a body 10. The feeder unit 20 is configured to feed a sheet P in the body 10, the image forming unit 30 is configured to form an image on the sheet P being fed, and the ejection unit 90 is configured to eject the sheet P with the image formed thereon outside. A configuration of the body 10 of the color printer 1 will be described later in detail.

The feeder unit 20 includes a feeder tray 21 to store the sheet P therein and a sheet conveyer 22 to convey the sheet P from the feeder tray 21 to the image forming unit 30.

The image forming unit 30 includes an optical scanner 40, a plurality of (e.g., four) processing units 50, a drawer 60, a transfer unit 70, and a fixing unit 80.

The optical scanner 40 is arranged on one side of the plurality of processing units 50 along a direction orthogonal to an axial direction and to an aligning direction of photosensitive drums 51, which will be described later in detail. In other words, the optical scanner 40 is arranged in an upper position with respect to the plurality of processing units 50, in the body 10. The optical scanner 40 includes a laser-beam emitter (not shown), a plurality of polygon mirrors (unsigned), lenses (unsigned), and a plurality of reflection mirrors (unsigned). Laser beams emitted from the laser-beam emitter for a plurality of (e.g., four) colors are reflected on the polygon mirrors and the reflection mirrors and transmit through the lenses to be casted to scan on surfaces of photosensitive drums 51 in the processing units 50.

The processing units 50 are aligned in line, along a direction of depth (i.e., a front-rear direction) of the color printer 1, orthogonally to the axial direction of rotation axes of the photosensitive drums 51. Each of the processing units 50 includes the photosensitive drum 51, which is rotatable about a rotation axis 51A thereof extending along the widthwise direction, a charger 52 to electrically charge the photosensitive drum 51, and a developer cartridge 53. Each developer cartridge 53 includes a developer roller 54 to supply a developer agent (e.g., toner) to the photosensitive drum 51 and a toner container 56 to store the toner therein. All the processing units 51 are configured similarly but different from one another in colors of the toner contained in the toner containers 56.

Each of the chargers 52 includes a charging wire 52A and a grid electrode 52B. The grid electrode 52B is arranged in a position between the charging wire 52A and the photosensitive drum 51.

Figure 2:
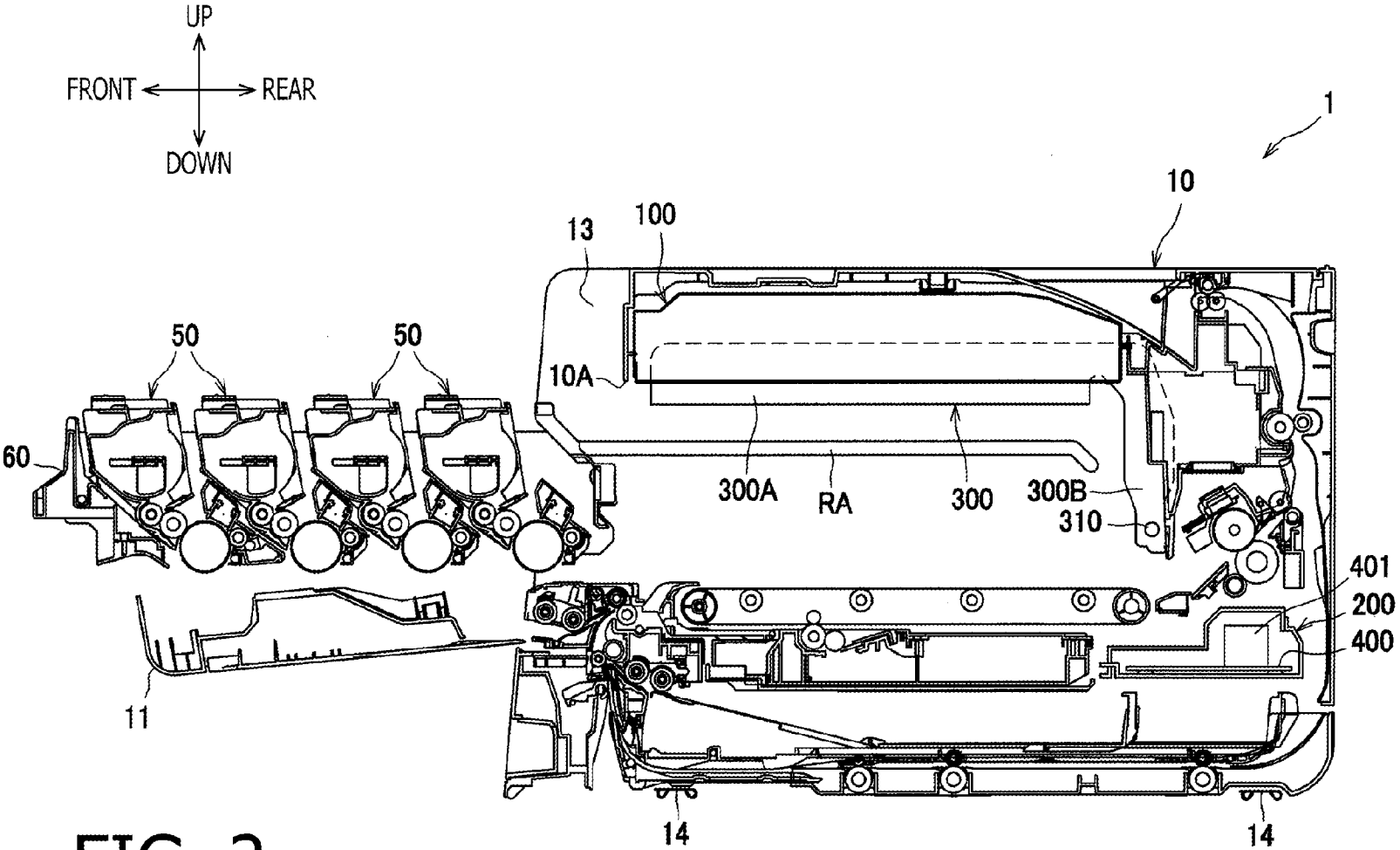
FIG. 2 is a cross-sectional side view of the color printer with a drawer being drawn out of a body of the color printer according to the embodiment of the present invention.
Figure 3:
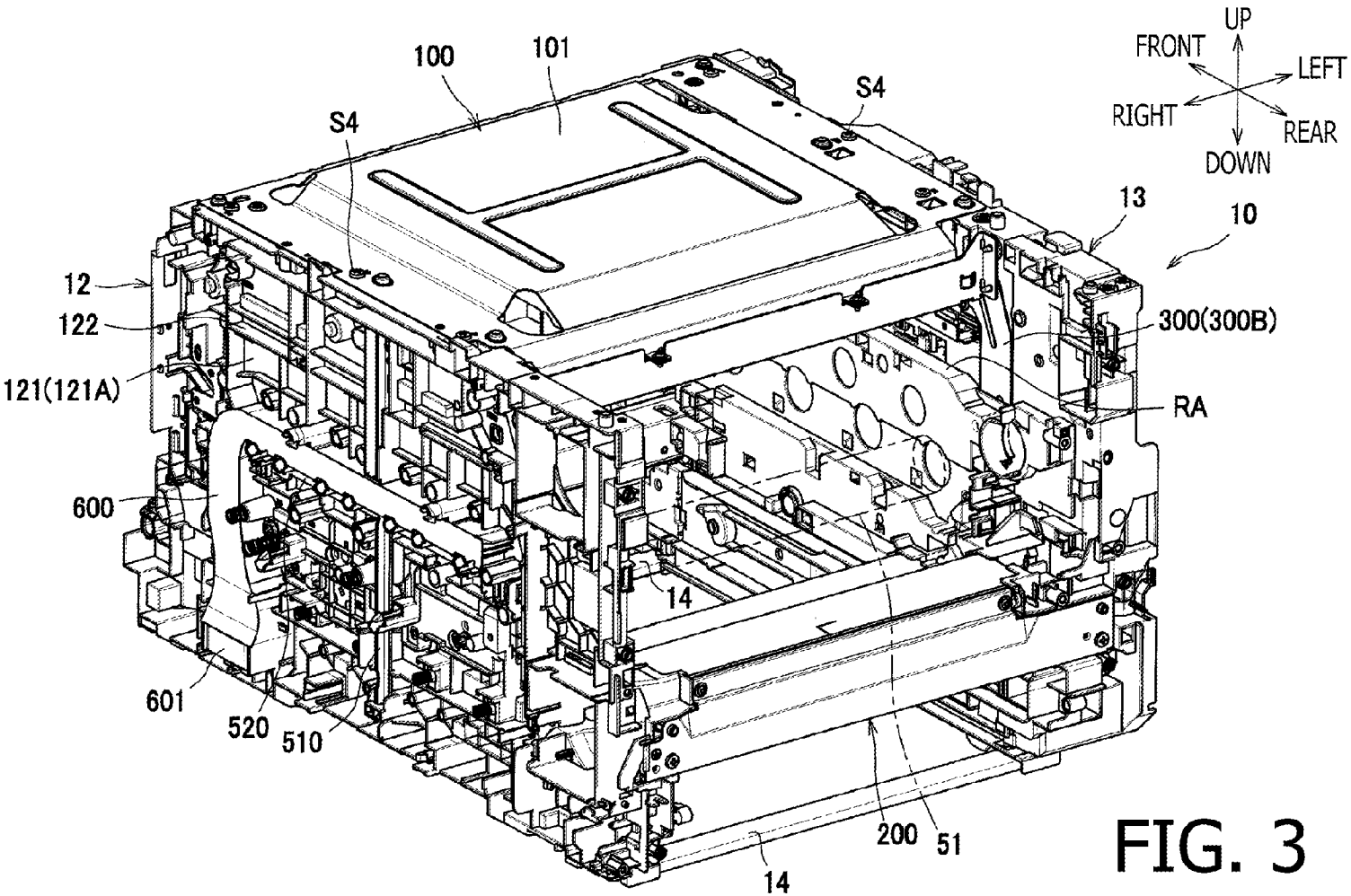
FIG. 3 is a perspective view of the body of the color printer with a framework according to the embodiment of the present invention.

The drawer 60 supports the plurality of processing units 50 and is movable along the front-rear direction with respect to a pair of side frames 12, 13, which form lateral walls of the body 10 of the color printer 1. Each of the side frames 12, 13 is provided with a rail RA, solely one of which on the left is shown in FIGS. 2 and 3, so that the drawer 60 is guided by the rails RA to move frontward or rearward along the front-rear direction. As shown in FIG. 2, the drawer 60 can be drawn out of the body 10 of the color printer 10 through an opening 10A, which is exposed when a front cover 11 arranged on the front side of the body 10 is opened. Thus, the processing units 50 are exposed to the outside atmosphere.

Referring back to FIG. 1, the transfer unit 70 is arranged in a position between the feeder unit 20 and the drawer 60. The transfer unit 70 includes a driving roller 71, a driven roller 72, a conveyer belt 73, and transfer rollers 74.

The driving roller 71 and the driven roller 72 are arranged to extend axially in parallel with each other in spaced-apart positions from each other along the front-rear direction so that the conveyer belt 73 being an endless belt is strained to roll around the driving roller 71 and the driven roller 72. The conveyer belt 73 is arranged to have an upper outer surface thereof to be in contact with the photosensitive drums 51. A plurality of (e.g., four) transfer rollers 74 are arranged in positions opposite from the photosensitive drums 51 across the conveyer belt 73, and the conveyer belt 73 is in contact with the transfer rollers 74 at an upper inner surface thereof. Transfer bias under constant current control is applied to the transfer rollers 74 to transfer an image from the photosensitive drums 51 to the sheet P.

The fixing unit 80 is arranged in a rear position with respect to the processing units 50 and includes a heat roller 81 and a pressure roller 82. The pressure roller 82 is arranged in a position to face the heat roller 81 and is urged against the heat roller 81.

In each of the processing units 50 in the image forming unit 30 configured as above, the charger 52 electrically charges a surface of the photosensitive drum 51 evenly, and the surface of the photosensitive drum 51 is exposed to the laser beam emitted selectively based on image data from the optical scanner 40 in order to form a lower-potential regions, i.e., an electrostatic latent image representing the image to be formed on the sheet P, thereon. Thereafter, the toner is supplied to the latent image on the photosensitive drum 51 from the developer cartridge 53 through the developer roller 54. Thus, the latent image is developed to be a toner image and carried on the surface of the photosensitive drum 51.

When the sheet P supplied from the feeder unit 20 is carried on the conveyer belt 73 to a position between the photosensitive drum 51 and the transfer roller 74, the toner image formed on the surface of the photosensitive drum 51 is transferred onto the sheet P. Thus, four colored images are sequentially overlaid on the surface of the sheet P to form a colored image. The sheet P with the transferred toner images is carried to a nipped position between the heat roller 81 and the pressure roller 82 in the fixing unit 80 to have the toner images thermally fixed thereon.

The ejection unit 90 includes a plurality of conveyer rollers 91 to convey the sheet P. The sheet P with the fixed image is ejected out of the body 10 of the color printer 1 by the conveyer rollers 91.

Configuration of the Body 10 of the Color Printer 1

As shown in FIG. 3, the body 10 of the color printer 1 includes the paired side frames 12, 13, a first connecting frame 100 to connect upper portions of the side frames 12, 13, a second connecting frame 200 to connect lower rear portions of the side frames 12, 13, and lower beams 14 to connect lower ends of the side frames 12, 13. The lower beams 14 are elongated metal bars extending along the widthwise direction. One of the lower beams 14 is arranged on the front side of the side frames 12, 13, and another one of the lower beams 14 is arranged on the rear side of the side frames 12, 13.

The side frames 12, 13 are resin plates, each of which is formed to have an approximate shape of a rectangle, and are arranged on the left side and the right side in the color printer 1 to have a predetermined amount of clearance there-between to accommodate the processing units 50 therein. The processing units 50 disposed in the clearance are supported by the side frames 12, 13 via the drawer 60. In the following description, one of the side frames 12, 13 arranged on the right-hand side may be referred to as a right-side frame 12, and the other one of the side frames 12, 13 arranged on the left-hand side may be referred to as a left-side frame 13.

The right-side frame 12 is made of a resin, such as acrylonitrile butadiene styrene (ABS). The right-side frame 12 is formed in an approximate shape of a rectangular plate, of which longer sides align along the front-rear direction, when viewed laterally along the widthwise direction, and supports right-side ends of the processing units 50 via the drawer 60. As shown in FIG. 3, the right-side frame 12 includes flat parts 121 having flat surfaces 121A, which spread orthogonally to the widthwise direction, and enhancing ribs 122, which protrude inward or outward from the flat parts 121 along the widthwise direction. The right-side frame 12 is enhanced by a first metal beam 510 and a second metal beam 520 (see FIG. 5), which will be described later in detail.

The left-side frame 13 is made of a resin, such as ABS. The left-side frame 13 is arranged to face the right-side frame 12 across the processing units 50 and supports left-side ends of the processing units 50 via the drawer 60. The left-side frame 13 includes the flat parts (unsigned) and enhancing ribs (unsigned), which are formed in shapes similar to the flat parts 121 and the enhancing ribs 122 in the right-side frame 12. On an outer side of the left-side frame 13 along the widthwise direction, a driving mechanism (not shown), including a plurality of gears to drive the photosensitive drums 51, is disposed. Thus, the driving mechanism disposed on the left-side frame 13 can enhance rigidity of the left-side frame 13.

The first connecting frame 100 is a metal frame forming a shape of a sleeve, which is hollow and provides a space inside, and a cross-section of the first connecting frame 100 taken along a plane orthogonal to the widthwise direction is closed. Widthwise ends of the first connecting frame 100 are connected to the side frames 12, 13. The first connecting frame 100 is arranged in an upper position with respect to the processing units 50 and accommodates the optical scanner 40 in the hollow space.

With the sleeve-shaped first connecting frame 100 connected to the side frames 12, 13 at the widthwise ends thereof, the first connecting frame 100 can enhance rigidity of the side frames 12, 13. In this regard, while the optical scanner 40 is accommodated in the first connecting frame 100, the first connecting frame 100 may not only provide the improved rigidity to the color printer 1 but also protect the optical scanner 40 securely.

The first connecting frame 100 is formed to have a dimension in the front-rear direction being substantially equivalent to a dimension in the front-rear direction of the drawer 60 and is arranged to overlap the processing units 50 in a perspective view projected along the vertical direction. Thus, due to the first connecting frame 100 arranged over the processing units 50, the rigidity of the side frames 12, 13 may be enhanced effectively by the first connecting frame 100.

Meanwhile, the first connecting frame 100 is arranged to locate a center C1 thereof along the front-rear direction in a frontward position deviated from a center C of the side frames 12, 13 along the front-rear direction. In other words, the first connecting frame 100 is arranged in a frontward off-centered position closer to the front ends rather than the rear ends of the side frames 12, 13.

Figure 4:
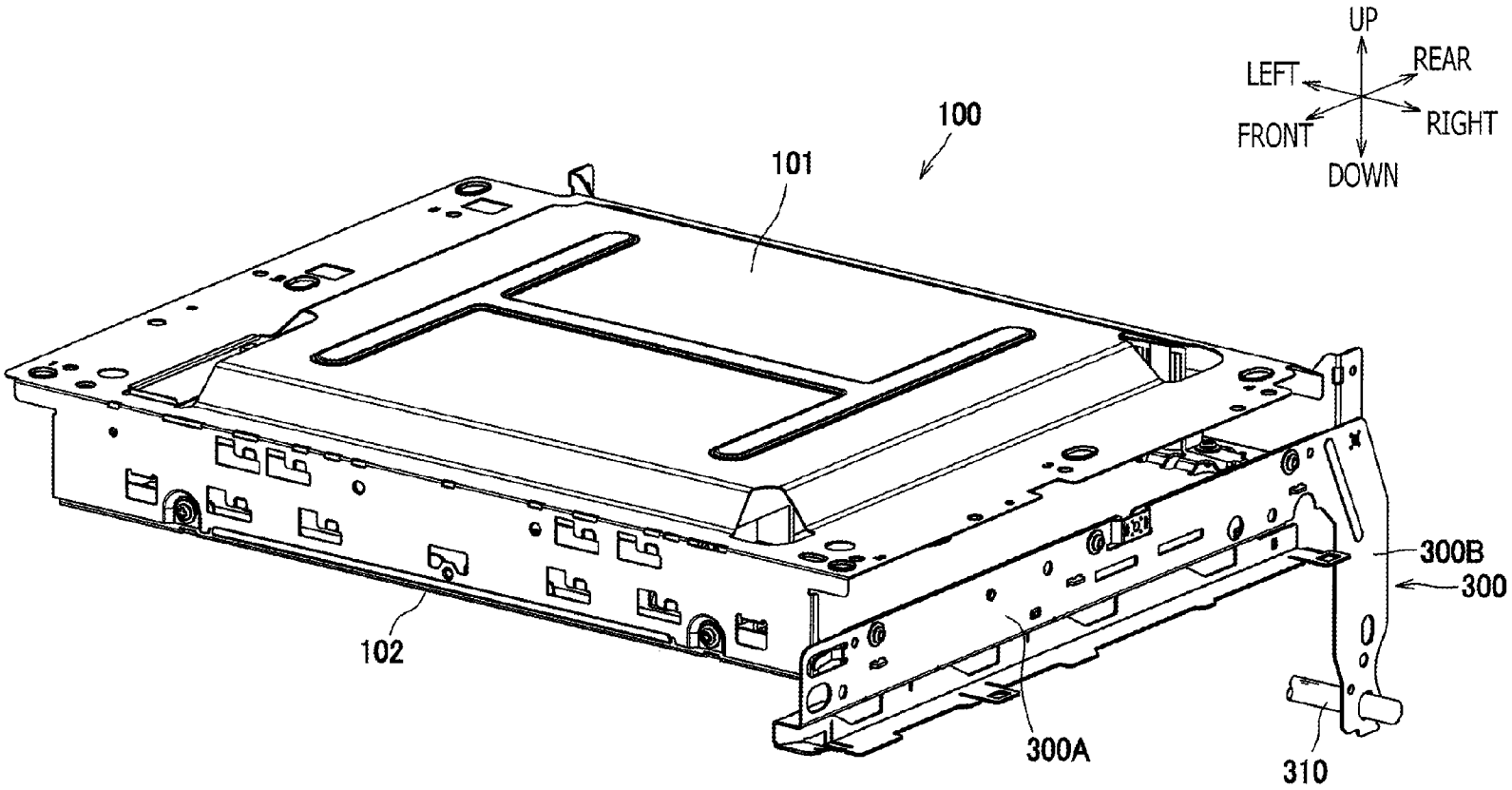
FIG. 4 is an exploded view of a first connecting frame and an L-shaped metal piece in the color printer according to the embodiment of the present invention taken from an upper front view point.

More specifically, as shown in FIGS. 3 and 4, the first connecting frame 100 is fixed to upper edges of the side frames 12, 13 by screws S4 at widthwise ends of a top wall 101 thereof, and to L-shaped metal pieces 300, which are fixed to the side frames 12, 13, at widthwise ends of a lower wall 102 thereof.

Each of the L-shaped metal pieces 300 is a sheet of metal including a main part 300A elongated along the front-rear direction and an extended part 300B extended downward from the main part 300A toward a side where the photosensitive drums 51 are disposed. The main part 300A is arranged to overlap the first connecting frame 100 in a perspective view projected along the widthwise direction. The extended part 300B supports a positioning shaft 310 (see also FIG. 1), which is engageable with a rear part of the drawer 60 to place the drawer 60 in a correct position in the body 10 of the color printer 1. The L-shaped metal pieces 300 are arranged along planar lateral sides of the side frames 12, 13, e.g., along the flat surfaces 121A of the right-side frame 12, and are fixed to upper areas of the side frames 12, 13 at inner positions in the side frames 12, 13 along the widthwise direction (see FIGS. 3 and 5). Thus, the L-shaped metal pieces 300 enhance the side frames 12, 13 at the upper areas.

Meanwhile, the L-shaped metal pieces 300 support the optical scanner 40 via the first connecting frame 100. Thereby, the L-shaped metal pieces 300 can serve to enhance the side frames 12, 13 and to support the optical scanner 40. Thus, compared to a configuration, in which enhancing pieces and supporting pieces are separately prepared, manufacturing cost for the color printer 1 may be effectively reduced.

As shown in FIGS. 1 and 3, the second connecting frame 200 is a metal frame formed in a shape of a sleeve, which is hollow and provides a space inside. A cross-section of the second connecting frame 200 is closed when taken along the plane orthogonal to the widthwise direction. The second connecting frame 200 is coupled to the side frames 12, 13 at widthwise ends thereof. The second connecting frame 200 is arranged in a lower position with respect to the processing units 50.

Thus, the first connecting frame 100 and the second connecting frame 200 are arranged to align along the vertical direction to place the processing units 50 interposed therebetween. Therefore, central areas of the side frames 12, 13, i.e., areas coincident with the processing units 50 along the direction of rotation axes, can be effectively enhanced.

According to the configuration described above, a central area C2 of the second connecting frame 200 along the front-rear direction is arranged in a rearward position deviated from the center C of the side frames 12, 13 along the front-rear direction. In other words, the second connecting frame 200 is arranged in the rearward off-centered position closer to the rear ends rather than the front ends of the side frames 12, 13. Therefore, with regard to the relative position among the second connecting frame 200, the side frames 12, 13, and the first connecting frame 100, the first connecting frame 100 is disposed in the frontward position closer to the front ends of the side frames 12, 13 while the second connecting frame 200 is disposed in the rearward position closer to the rear ends of the side frames 12, 13. Thus, the first connecting frame 100 and the second connecting frame 200 are disposed in diagonal positions with respect to each other in the side frames 12, 13. Accordingly, the rigidity of the body 10 of the color printer 1 may be effectively improved.

According to the configuration described above, the second connecting frame 200 is formed to range from a position in proximity to the rear end of the first connecting frame 100 to a position in proximity to the rear ends of the side frames 12, 13 along the front-rear direction. Further, the second connecting frame 200 is arranged to overlap the first connecting frame 100, at least partly, in the perspective view projected along the vertical direction. Therefore, an entire range of the side frames 12, 13 along the front-rear direction is enhanced by the first and second connecting frames 100, 200, and the rigidity of the first and second connecting frames 100, 200 may be effectively improved.

Meanwhile, inside the second connecting frame 200, a power board 400 to supply power to electrically movable components, such as the processing units 50, is disposed. On the power board 400, a transformer 401 (see FIGS. 1, 2, and 7) being one of elements composing a power circuit, is mounted. While the power board 400 is accommodated in the metal-made second connecting frame 200, noises generated in the power board 400 may be prevented from being radiated.

Figure 5:
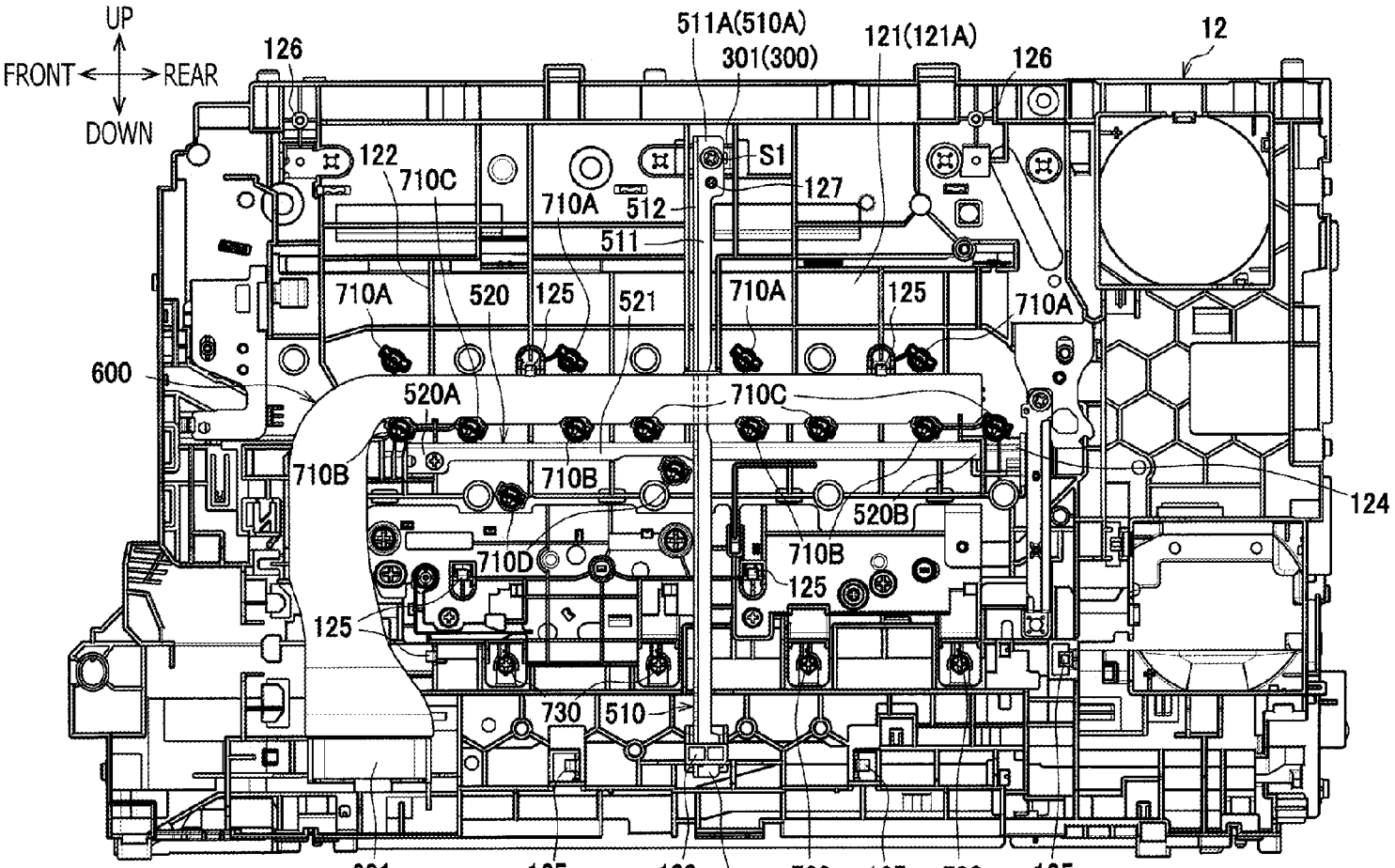
FIG. 5 is a lateral view of a right-side frame in the color printer according to the embodiment of the present invention viewed from an outer side along a widthwise direction.
Figure 6:
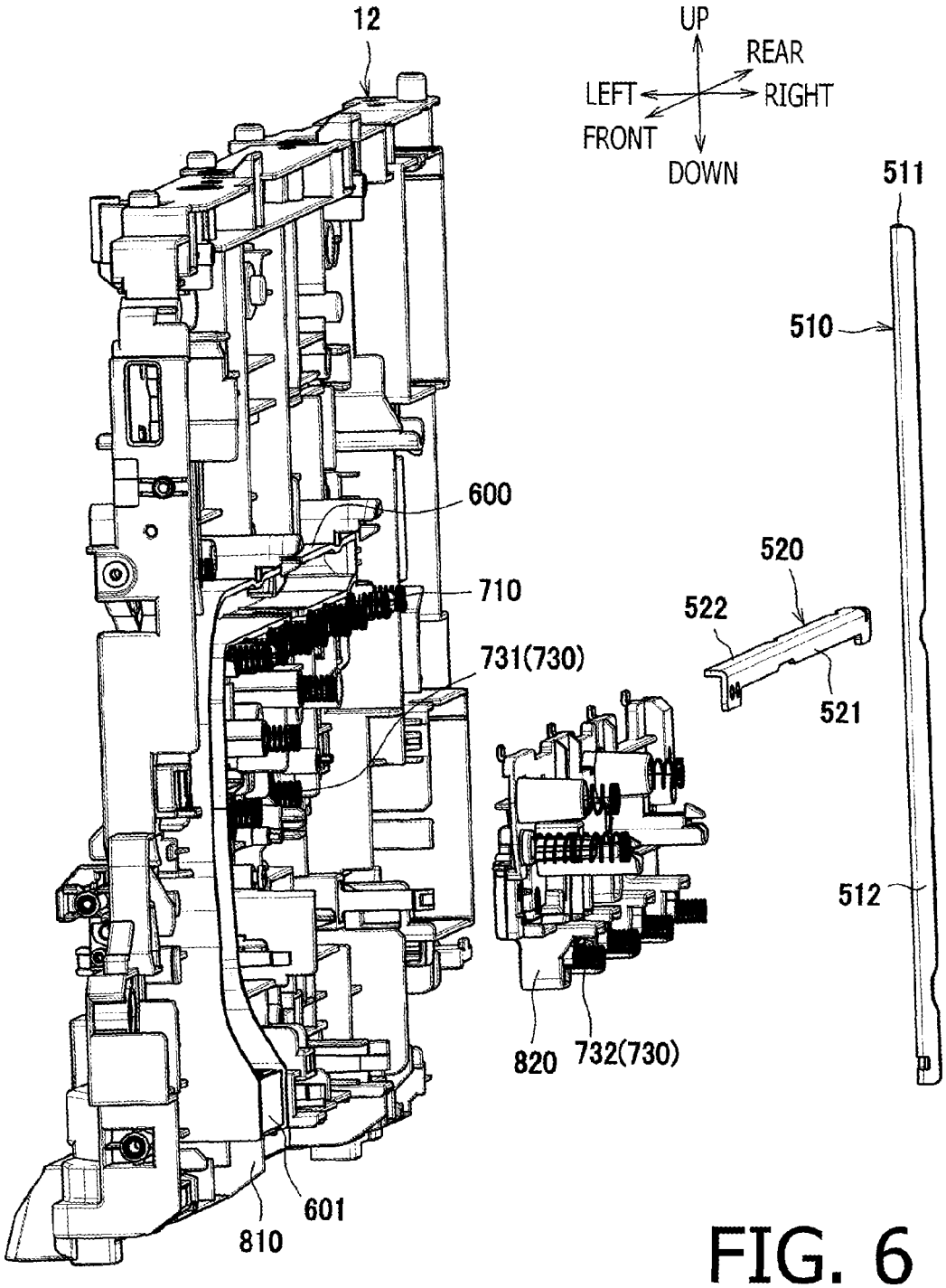
FIG. 6 is an exploded perspective view of the right-side frame, a subsidiary frame, first and second metal beams in the color printer according to the embodiment of the present invention.

As shown in FIGS. 5 and 6, the first metal beam 510 is formed in a shape of an elongated bar longitudinally arranged along the vertical direction. The first metal beam 510 is made of a material different from the right-side frame 12, for example, a metal such as iron having a different thermal expansion coefficient from the resin in the right-side frame 12. The first metal beam 510 is arranged along a planar face of the right-side frame 12, which includes the flat surfaces 121A of the flat parts 121, and fixed to the outer side of the right-side frame 12 along the widthwise direction. With the first metal beam 510, the resin-made right-side frame 12 is enhanced at the side; therefore, for example, compared to a resin-made right-side frame without an enhancing beam, the right-side frame 12 with improved rigidity may be provided.

The first metal beam 510 is formed in a shape of a bar having shorter sides and longer sides in a lateral view along the widthwise direction. In this regard, the shorter sides align with the front-rear direction of the right-side frame 12, and a dimension of the shorter sides is substantially smaller with respect to a dimension of the right-side frame 12 along the front-rear direction. In particular, the dimension of the shorter sides of the first metal beam 510 along the front-rear direction is approximately at most 1/47 of the dimension of the right-side frame 12 along the front-rear direction. With the substantially smaller dimension with respect to the dimension of the resin-made right-side frame 12 along the front-rear direction, a weight of the color printer 1 can be reduced to be less compared to, for example, the conventional printer with a side frame consisting of a larger metal plate with planar dimension. The dimension of the first metal beam 510, at a largest part, along the front-rear direction may be between 1/10 and 1/100 with respect to the dimension of a largest part of the right-side frame 12 along the front-rear direction, and it may even be preferable to set the ratio within a range between 1/40 and 1/50.

The first metal beam 510 is arranged to vertically penetrate through a duct 600, which is arranged on the right-side frame 12. An upper end portion 510A of the first metal beam 510 is fixed to an upper part of the right-side frame 12 and to the L-shaped metal piece 300 while a lower end portion 510B of the first metal beam 510 is engaged with a lower part of the right-side frame 12. The duct 600 provides an air channel for the air, which is introduced by a fan 601 and conveyed to the processing units 50.

Figure 7:
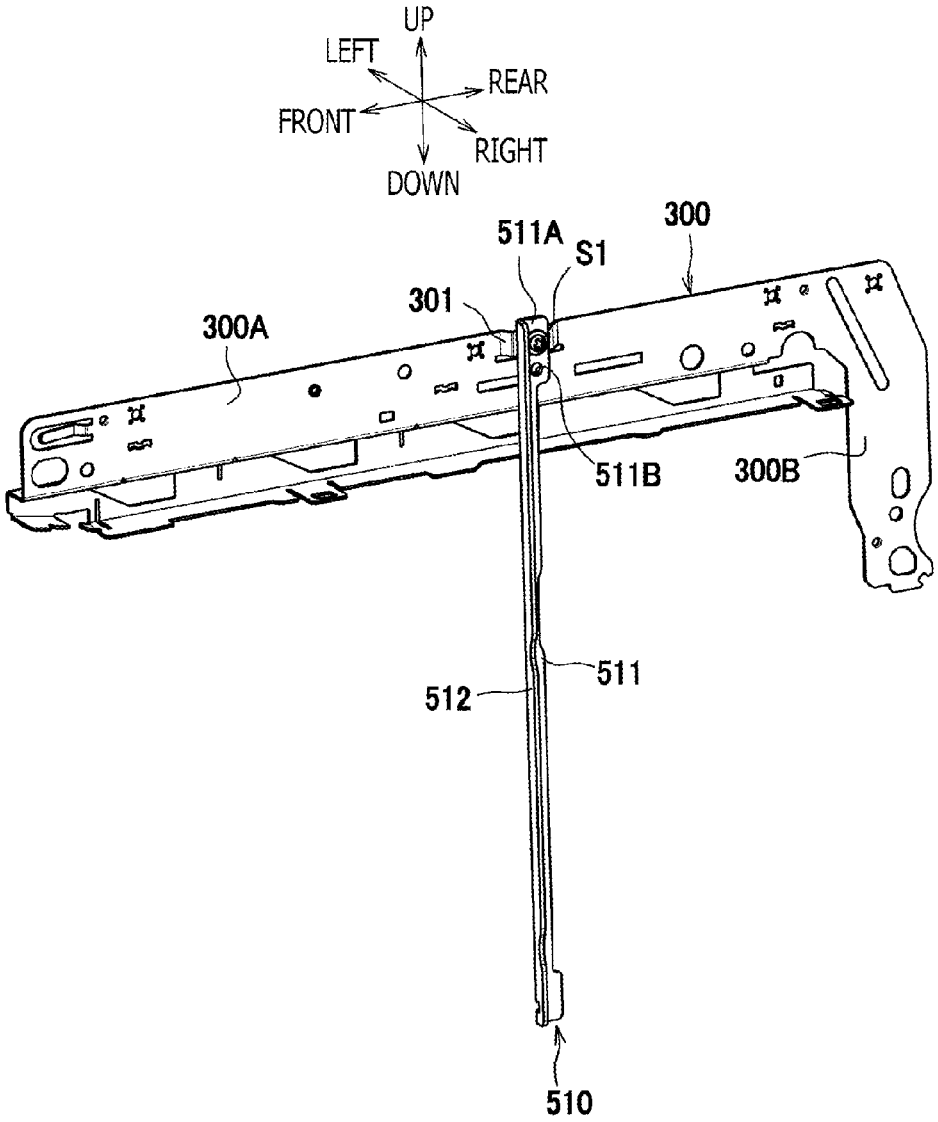
FIG. 7 is a perspective view of the L-shaped metal piece and a first metal beam in the color printer according to the embodiment of the present invention.

As shown in FIG. 7, the first metal beam 510 is formed of an elongated thin metal bar bent along the longitudinal direction to form a cross-sectional shape of an L. The first metal beam 510 includes a first section 511, which spreads orthogonally to the widthwise direction, and a second section 512, which spreads from a front end of the first section 511 outward along the widthwise direction. The first section 511 is formed to have two openings 511B, which align along the vertical direction, in an upper-end portion 511A of the first section 511. In an upper one of the openings 511B, a screw S1 to fasten the first metal beam 510 to one of the L-shaped metal pieces 300 on the right is inserted.

More specifically, in an approximately central area along the front-rear direction in the main part 300A of the L-shaped metal piece 300, a bulge 301 protruding outward along the widthwise direction is formed. As shown in FIGS. 5 and 7, the bulge 301 is arranged to protrude outward along the widthwise direction with respect to the flat part 121 through an opening (unsigned) formed in the flat part 121 of the right-side frame 12. While the upper-end portion 511A of the first section 511 of the first metal beam 510 is placed over the bulge 301, the screw S1 is inserted through the upper opening 511B in the upper-end portion 511A and screwed to the L-shaped metal piece 300. Thereby, the first metal beam 510 is fixed to the L-shaped metal piece 300 at the upper-end portion 511A of the first section 511. In this regard, the first metal beam 510 is arranged to intersect with the main part 300A of the L-shaped metal piece 300 while an upper-end portion 510A of the first metal beam 510 is fixed to a position between the longitudinal ends of the main part 300A along the front-rear direction. Thus, with the first metal beam 510 and the L-shaped metal piece 300 forming a shape of a "T", the right-side frame 12 can be enhanced effectively.

Thus, the upper end portion 510A of the first metal beam 510 is fixed to the L-shaped metal piece 300, which is fixed to the right-side frame 12. In other words, the first metal beam 510 is fixed to the right-side frame 12 by being fixed to the L-shaped metal piece 300. More specifically, the upper-end portion 511A of the first section 511, which is fixed to the L-shaped metal piece 300 by the screw S1, i.e., the upper end portion 510A of the first metal beam 510, is fixed to the right-side frame 12 immovably in the vertical, widthwise, and front-rear directions. In this regard, the L-shaped metal piece 300 and the first metal beam 510 are arranged on opposite sides from each other across the right-side frame 12 along the widthwise direction. In other words, the right-side frame 12 is interposed between the L-shaped metal piece 300, which is arranged on the inner side of the right-side frame 12, and the first metal beam 510, which is arranged on the outer side of the right-side frame 12.

Meanwhile, in a lower one of the openings 511B formed in the upper-end portion 511A of the first section 511, a boss 127 formed in the right-side frame 12 is inserted to place the first metal beam 510 in a correct position with respect to the right-side frame 12. In other words, by inserting the boss 127 of the right-side frame 12 into the lower one of the openings 511B in the upper-end portion 511A, the upper-end portion 511A of the first section 511 is placed in the correct position with respect to the right-side frame 12.

Figure 8A:
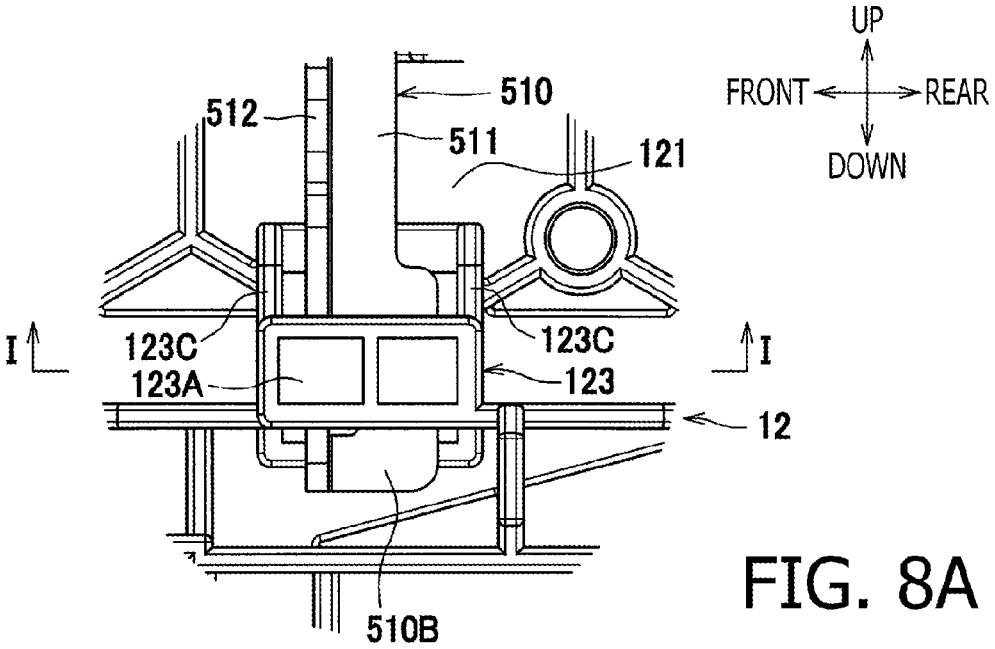
FIG. 8A is an enlarged view of a lower part of the first metal beam and a first engageable part in the color printer according to the embodiment of the present invention.
Figure 8B:
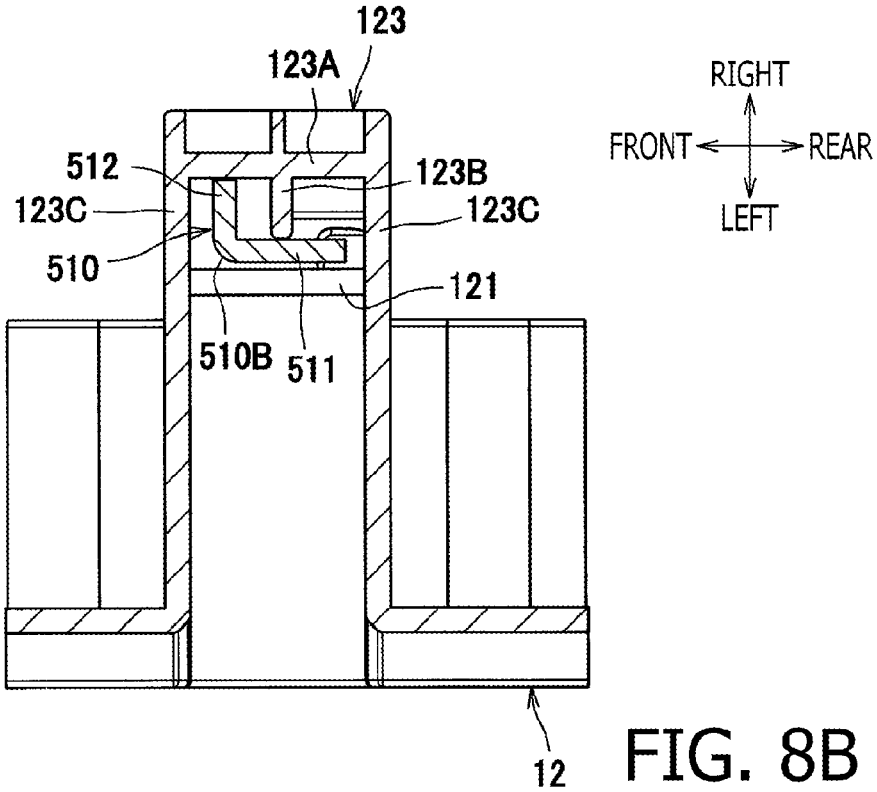
FIG. 8B is a cross-sectional view of the lower part of the first metal beam and the first engageable part in the color printer according to the embodiment of the present invention taken along a line I-I shown in FIG. 8A.

The lower end portion 510B of the first metal beam 510 is engaged with a first engageable part 123 formed in the right-side frame 12. As shown in FIGS. 8A and 8B, the first engageable part 123 includes a first engageable block 123A, a second engageable block 123B, and paired connecting blocks 123C. The first engageable block 123A is arranged on a right-hand side, i.e., an outer side, of the second section 512 of the first metal beam 510 along the widthwise direction and is engageable with the edge of the second section 512. The second engageable block 123B is arranged to extend leftward, i.e., inward along the widthwise direction, from a center of the first engageable block 123 along the front-rear direction to be engageable with the first section 511 of the first metal beam 510. The paired connecting blocks 123C are arranged to extend leftward from front and rear ends of the first engageable block 123A to be connected to the flat part 121 of the right-side frame 12.

The lower end portion 510B of the first metal beam 510 is placed in a position between the first and second engageable blocks 123A, 123B, and the flat part 121 along the widthwise direction. Thus, the lower end portion 510B of the first metal beam 510 is restricted from moving in the widthwise direction. In this regard, the lower end portion 510B of the first metal beam 510 is arranged to penetrate an area surrounded by the first engageable block 123A, the second engageable block 123*b*, the paired connecting blocks 123C, and the flat part 121 to protrude downward from the first engageable part 123 so that the lower end portion 510B of the first metal beam 510 is allowed to move vertically with respect to the right-side frame 12.

Thus, the lower end portion 510B of the first metal beam 510 is attached to the right-side frame 12 to be immovable in the widthwise direction while the lower end portion 510B of the first metal beam 510 is attached to the right-side frame 12 movably in the longitudinal direction (i.e., vertically) with respect to the right-side frame 12. This one-way movable and another-way immovable attaching structure of the first metal beam 510 may be effective for the body 10 of the color printer 1 to cope with changes of environments surrounding the color printer 1 or with an impact which may be caused by a fall. That is, for example, due to a difference between the thermal expansion rates between the first metal beam 510 and the right-side frame 12, or to an impact caused by a fall of the color printer 1, even when the right-side frame 12 is deformed largely with respect to the first metal beam 510 along the longitudinal direction of the first metal beam 510, the right-side frame 12 may be allowed to deform independently from the first metal beam 510, and the deformation of the right-side frame 12 should not be restricted by the first metal beam 510. Therefore, the first metal beam 510 and the right-side frame 12 are prevented from being distorted with respect to each other.

In this regard, the thermal expansion rate of the resin-made right-side frame 12 is generally greater than the thermal expansion rate of the metal-made first metal beam 510. However, while the lower end portion 510B of the first metal beam 510 protrudes downward from the first engageable part 123, the lower end portion 510B of the first metal beam 510 is prevented from being disengaged from the first engageable part 123.

While the lower end portion 510B of the first metal beam 510 is engaged with the first engageable part 123, in a lower area with respect to the lower end portion 510B of the first metal beam 510, a clearance to absorb the difference in the thermal expansion rates is reserved. Thereby, even when the right-side frame 12 is thermally contracted, the lower end portion 510B is prevented from being in conflict with by another part of the body 10 or other components in the color printer 1.

As shown in FIGS. 5 and 6, the second metal beam 520 is in a structure similar to the first metal beam 510. Therefore, the second metal beam 520 includes a first section 521 and a second section 522, which are similar to the first section 511 and the second section 512 of the first metal beam 510, and is made of the same material as the first metal beam 510. Accordingly, the first metal beam 510 and the second metal beam 510 provide equal rigidity. The second metal beam 520 is arranged on an inner side with respect to the first metal beam 510 along the widthwise direction. The second metal beam 520 is fixed to the right-side frame 12 and arranged to extend longitudinally along the front-rear direction, orthogonally to the first metal beam 510. More specifically, the second metal beam 520 and the first metal beam 510 are arranged to overlap each other at longitudinal center portions thereof, when viewed laterally along the widthwise direction, to intersect crosswise with each other. With the intersecting first and second metal beams 510, 520, the rigidity of the right-side frame 12 can be improved even more.

While the first metal beam 510 and the second metal beam 520 are arranged to contact each other at the intersecting portions, the first metal beam 510 and the second metal beam 520 are not fixed to each other but are unfixed to each other at a mutually intersecting part thereof. Therefore, for example, when one of the first metal beam 510 and the second metal beam 520 is deformed due to thermal expansion with respect to the other in the longitudinal direction, the deformation of the former is not restricted by the latter. Thus, the former one of the first metal beam 510 and the second metal beam 520 is allowed to deform without being distorted.

The second metal beam 520 is arranged along the flat surfaces 121A of the flat surfaces 121A of the flat parts 121 in the right-side frame 12 in an orientation, in which an edge of the second section 522 faces inward (leftward) along the widthwise direction. In other words, the edge of the second section 512 of the first metal beam 510 and the edge of the second section 522 of the second metal beam 520 face opposite directions from each other along the widthwise direction. Therefore, flat surfaces of the first section 511 in the first metal beam 510 and the first sections 521 in the second metal beam 520 are placed in close contact with each other. Accordingly, the second beam 520 can be firmly held in the position between the first metal beam 510 and the right-side frame 12 while the second metal beam 520 is restricted from being distorted.

Figure 9A:
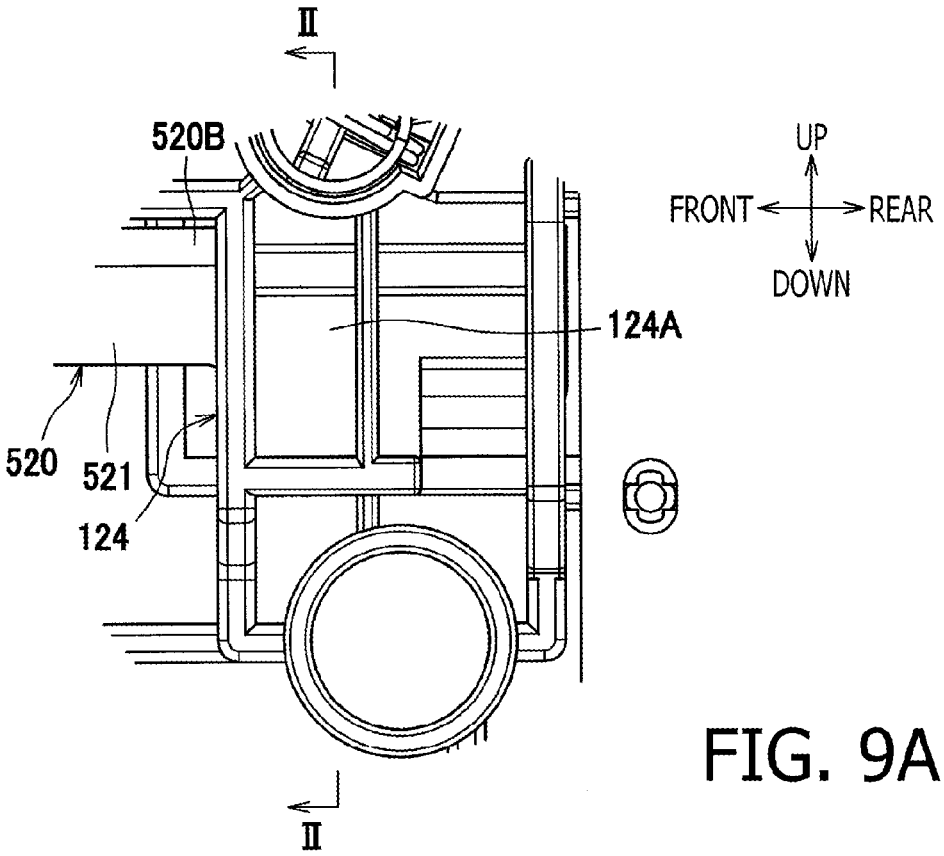
FIG. 9A is an enlarged view of a rear part of a second metal beam and a second engageable part in the color printer according to the embodiment of the present invention.
Figure 9B:
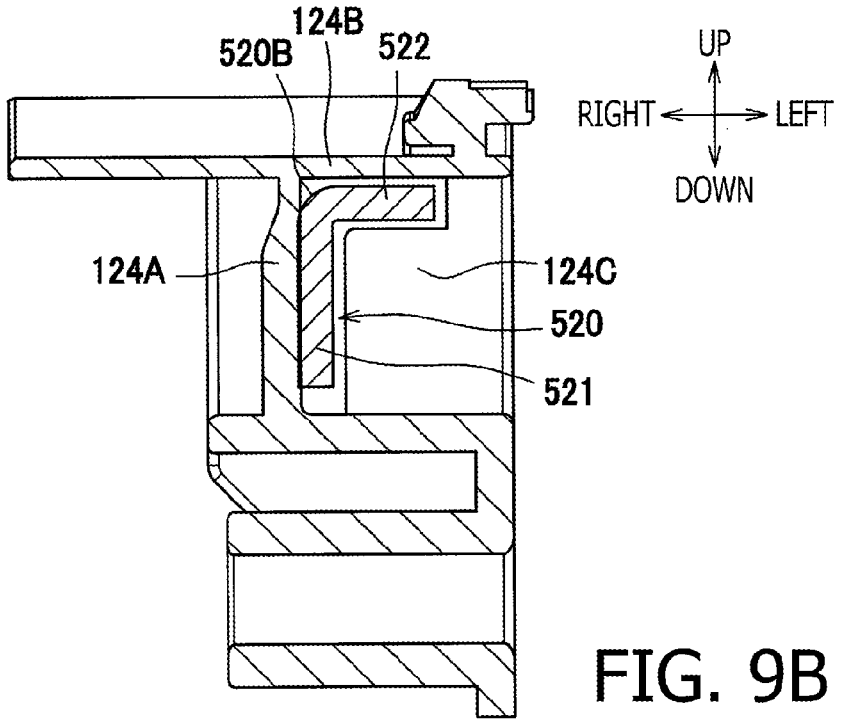
FIG. 9B is a cross-sectional view of the rear part of the second metal beam and the second engageable part in the color printer according to the embodiment of the present invention taken along a line II-II shown in FIG. 9A.

The second metal beam 520 is fixed to the right-side frame 12 at a front-end tab 520A while a rear end 520B of the second metal beam 520 is engaged with a second engageable part 124 formed in the right-side frame 12. As shown in FIGS. 9A and 9B, the second engageable part 124 includes a first restrictive block 124A, a second restrictive block 124B, and a third restrictive block 124C. The first restrictive block 124A is arranged on a right-hand side, i.e., the outer side, of the second metal beam 520 along the widthwise direction. The second restrictive block 124B is arranged in an upper position with respect to the second metal beam 520. The third restrictive block 124C is arranged on a left-hand side, i.e., an inner side, of the second metal beam 520.

The third restrictive block 124C is formed to have a right-side end thereof to fit with the shape of the second metal beam 520. Therefore, the second metal beam 520 is restricted by the first restrictive block 124A and the third restrictive block 124C from being moved in the widthwise direction while the second section 522 of the second metal beam 520 is restricted from being moved vertically by the second restrictive block 124B and the third restrictive block 124.

While the rear end 520B of the second metal beam 520 is engaged with the second engageable part 124, in a rearward area with respect to the rear end 520B of the second metal beam 520, a clearance to absorb the difference in the thermal expansion rates is reserved. Thereby, even when the right-side frame 12 is thermally contracted, the rear end 520B is prevented from being in conflict with another part of the body 10 or other components in the color printer 1.

The arrangement of the first metal beam 510 and the second metal beam 520 will be described in detail hereinbeow.

Figure 10:
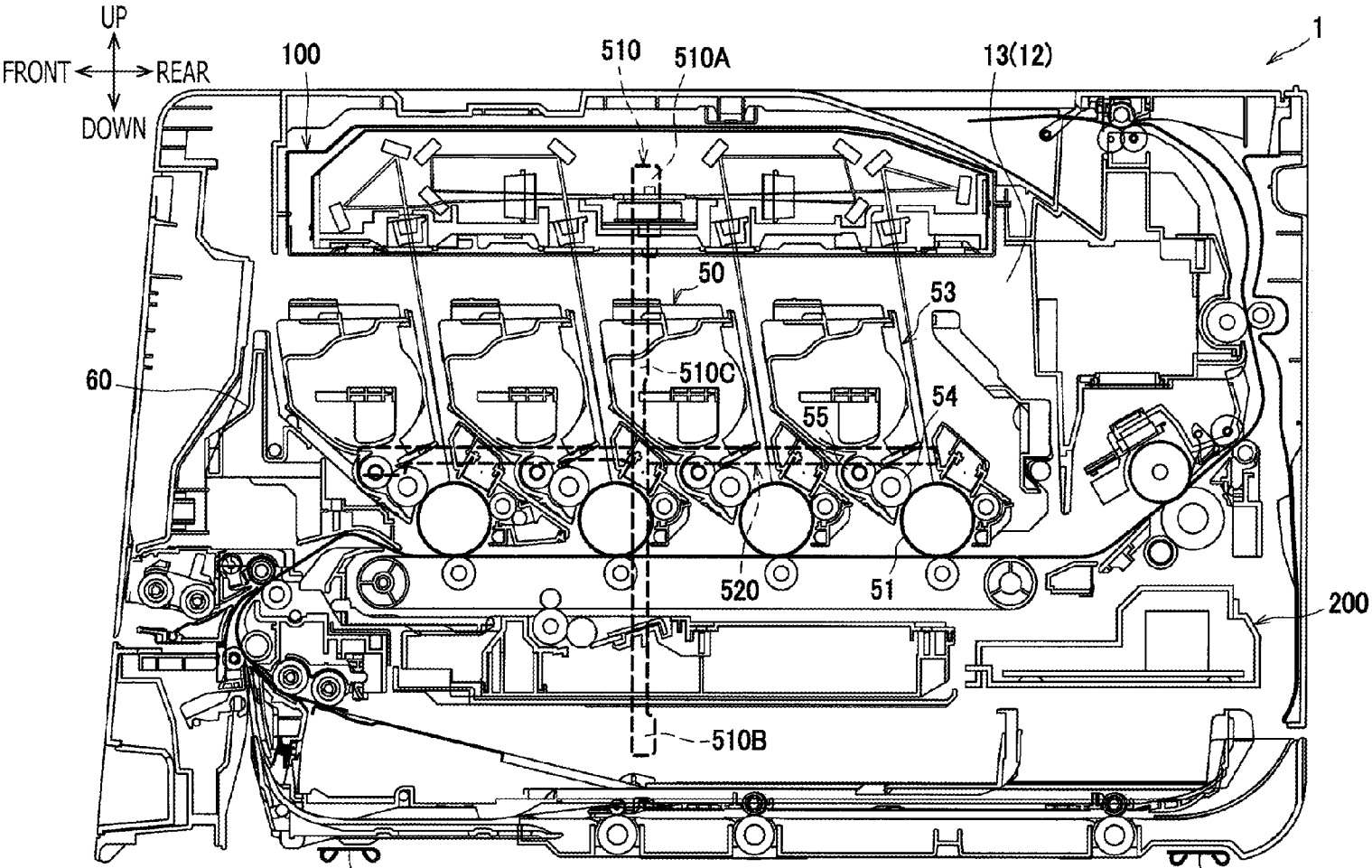
FIG. 10 is a cross-sectional side view of the color printer with the first and second metal beams and processing units according to the embodiment of the present invention.

As shown in FIG. 10, the first metal beam 510 overlaps at least one of the processing units 50 at a central part 510C in a perspective view laterally projected along the widthwise direction. In this regard, the upper end portion 510A and the lower end portion 510B of the first metal beam 510 are located in vertically outer side areas with respect to the processing units 50. Therefore, a force applied from the processing units 50 to the right-side frame 12, in particular, a force applied to a part of the right-side frame 12 which supports the drawer 60, can be borne by the first metal beam 510 rigidly.

The first metal beam 510 is, when viewed laterally along the widthwise direction, i.e., in an angle to face the planar lateral side of the right-side frame 12 orthogonally, as seen in FIG. 10, fixed to an upper-end part and a lower-end part on the longer sides of the right-side frame 12 at the upper end portion 510A and the lower end portion 510B respectively at least along the widthwise direction. In other words, the first metal beam 510 is arranged on the right-side frame 12 to longitudinally extend orthogonally to a direction of the longer sides of the right-side frame 12, i.e., orthogonally to the front-rear direction. Therefore, a length of the first metal beam 510 can be shortened compared to, for example, an arrangement in which the first metal beam 12 is arranged to extend between the shorter sides of the right-side frame 12, from a front end to a rear end of the right-side frame 12. Thus, the weight of the color printer 1 may be reduced. In the above and following description, the terms the upper and lower end parts on the longer sides of the right-side frame 12 refer to an upper area and a lower area among vertically trisected areas in the right-side frame 12.

The upper end portion 510A of the first metal beam 510 is arranged to overlap the first connecting frame 100 in the perspective view projected laterally along the widthwise direction. In this arrangement, deformation of the first metal beam 510 in the widthwise direction can be restricted by the first connecting frame 100, and the rigidity of the right-side frame 12 may be enhanced even more.

In other words, the upper end portion 510A of the first metal beam 510 is fixed to a more rigid part of the right-side frame 12, i.e., a connected area where the right-side frame 12 is connected with the first connecting frame 100, than other less rigid parts. Therefore, while the second metal beam 520 is supported by the first metal beam 510, which is fixed to the more rigid part and is more difficult to deform, the second metal beam 520 can be restricted from being deformed more effectively. Accordingly, the rigidity of the right-side frame 12 may be enhanced even more.

Further, the second metal beam 520 is arranged to overlap the drawer 60 in the perspective view projected laterally along the widthwise direction. In this regard, while the drawer 60 should be movably supported by the side frames 12, 13 to move with respect to the body 10 of the color printer 1, the movable area for the drawer 60, needs to be clear from the first and second connecting frames 100, 200. Meanwhile, with the second metal beam 520 arranged to overlap the drawer 60 in the perspective view projected laterally along the widthwise direction, the part of the right-side frame 12 corresponding to the movable area for the drawer 60 can be enhanced by the second metal beam 520.

Figure 11:
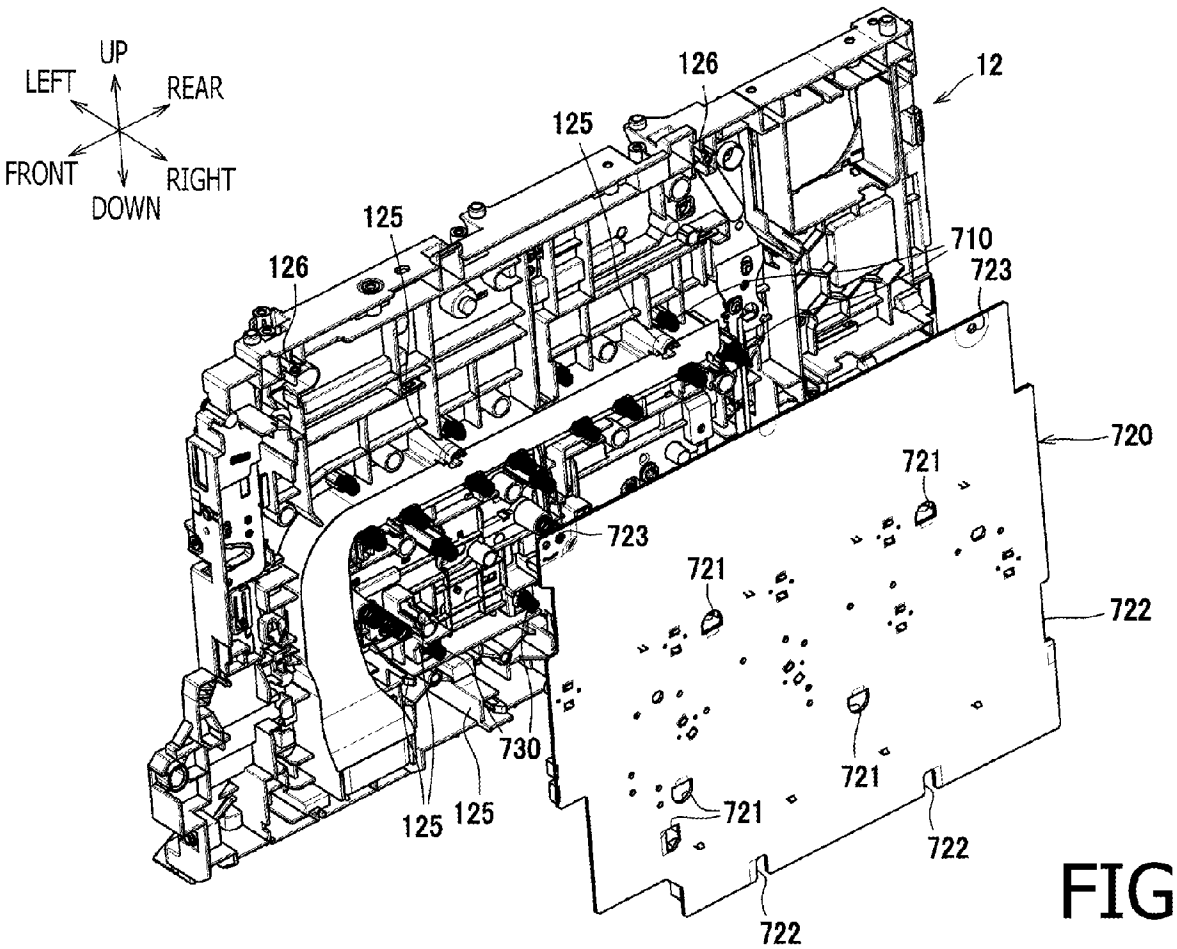
FIG. 11 is an exploded perspective view of spring electrodes and a substrate in the color printer according to the embodiment of the present invention.

As shown in FIG. 11, while the right-side frame 12 is enhanced by the first and second metal beams 510, 520, resilient forces from a plurality of spring electrodes 710, which supply power to the processing units 50, and a plurality of spring electrodes 730, which supply power to the transfer unit 70, are applied to the right-side frame 12 enhanced by the first and second metal beams 510, 520. On the outer side of the right-side frame 12 along the widthwise direction, a substrate 720 is arranged. The substrate 720 converts the electricity supplied from the power board 400 (see FIG. 1) into suitable electricity and distributes the converted electricity to the processing units 50 and the transfer unit 70 via the spring electrodes 710, 730. With the substrate 720 arranged on the outer side of the right-side frame 12 along the widthwise direction, it is noted that the drawer 60 is prevented from being interfered with by the substrate 720 when the drawer 60 is moved into or out of the body 10 of the color printer 1.

The right-side frame 12 includes a plurality of substrate supports 125, 126 to support the substrate 720 on the outer side thereof, i.e., on the opposite side from the processing units 50, along the widthwise direction (see also FIG. 5). Each of the substrate supports 125 has a claw (unsigned), which is deformable along the direction orthogonal to the widthwise direction. The substrate supports 125 support the substrate 720 by placing the claws engaged with openings 721 and cutouts 722 formed in the substrate 720. In upper positions in the substrate 720, through holes 723 are formed, and screws penetrating through the through holes 723 are fastened to the substrate supports 126. Thus, the substrate supports 126 support the substrate 720 by the fastening.

Figure 12:
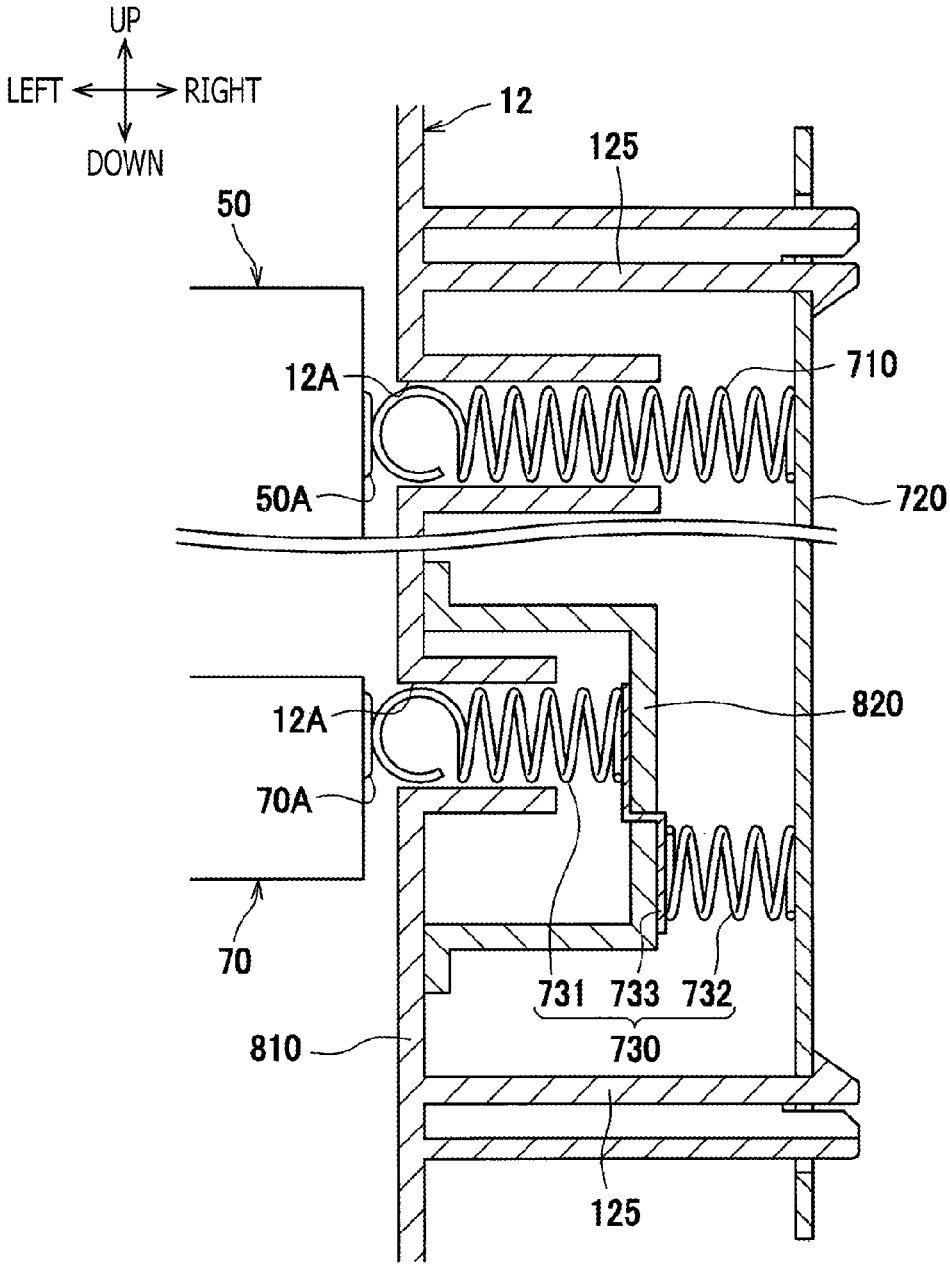
FIG. 12 is a cross-sectional view of the right-side frame with the spring electrodes and the substrate in the color printer according to the embodiment of the present invention.

As illustrated in FIG. 12, the spring electrodes 710 are arranged in upper positions with respect to the spring electrodes 730. Each of the spring electrodes 710 includes a compressed coiled spring and is supported by the right-side frame 12 in a compressed condition to be resiliently urged against one of electrodes 50A of the processing units 50. The spring electrodes 710, 730 may be, but not limited to, directly in contact with the electrodes 50A of the processing units 50. For example, the spring electrodes 710, 730 may be in indirectly contact with the electrodes of the processing units 50 via intermediate conductors arranged on the drawer 60.

The spring electrodes 730 are arranged in lower positions with respect to the spring electrodes 710. Each of the spring electrodes 730 includes a first spring electrode 731, a second spring electrode 732, and an intermediate conductor 733. The first spring electrode 731 is connected with an electrode 70A of the transfer unit 70, and the second spring electrode 732 is connected with the substrate 720. The intermediate conductor 733 connects the first spring electrode 731 and the second spring electrode 732 with each other.

The first spring electrode 731 is a compressed coiled spring electrode and is supported by the right-side frame 12 in a compressed condition to be resiliently urged against one of the electrodes 70A of the transfer unit 70. More specifically, while the right-side frame 12 includes a main frame 810 and a subsidiary frame 820, which is fixed to an outer side of the main frame 810 (see also FIG. 6), the first spring electrode 731 is arranged in between the transfer unit 70 and the subsidiary frame 820.

The intermediate conductor 733 is arranged to penetrate through the subsidiary frame 820 along the widthwise direction.

The second spring electrode 732 is a compressed coiled spring electrode and is supported by the subsidiary frame 820 in a compressed condition in between the intermediate conductor 733 and the substrate 720.

With the spring electrodes 710, 730 with resiliency, the spring electrodes 710, 730 can be connected to the processing units 50, the transfer unit 70 and to the substrate 720 steadily. Further, the processing units 50 can be restricted from being moved in the widthwise direction with respect to the right-side frame 12. While the resilient force from the spring electrodes 710, 730 is applied to the right-side frame 12, with the first and second metal beams 510, 520 enhancing the right-side frame 12, the rigidity of the right-side frame 12 can be enhanced, and deformation of the right-side frame 12 can be restricted.

In the right-side frame 12, a plurality of holes 12A, in which the spring electrodes 710, 730 are inserted to be supported, are formed along a direction of thickness (i.e., the widthwise direction). While the holes 12A may decrease intensity of the right-side frame 12, with the first and second metal beams 510, 520 enhancing the right-side frame 12, the rigidity of the right-side frame 12 can be maintained or enhanced, and deformation of the right-side frame 12 can be restricted.

The spring electrodes 710 include, as shown in FIG. 5, four (4) electrodes 710A for wires, four (4) electrodes 710B for developers, four (4) electrodes 710C for grids, and two (2) electrodes 710D for drums. The electrodes 710A for wires are electrodes to supply electricity to the charging wires 52A. Each of the charging wires 52A is provided with one of the electrodes 710A, and the electrodes 710A as well as the charging wires 52A are arranged at equal intervals from one another to align along the front-rear direction. The electrodes 710B for developers are electrodes to supply electricity, more specifically, developer bias, to the developer cartridges 53. Each of the developer cartridges 53 is provided with one of the electrodes 710B, and the electrodes 710B as well as the developer cartridges 53 are arranged at equal intervals from one another to align along the front-rear direction. More specifically, each of the electrodes 710B supplies electricity to the developer roller 54 and the supplier roller 55 in one of the developer cartridges 53. The electrodes 710C for grids are electrodes to supply electricity to the grid electrodes 52B. Each of the grid electrodes 52B is provided with one of the electrodes 710C, and the electrodes 710C as well as the grid electrodes 52B are arranged at equal intervals from one another to align along the front-rear direction. The electrodes 710D for drums are electrodes to supply electricity to the photosensitive drums 51 and are arranged in lower positions with respect to the electrodes 710C for grids.

The spring electrodes 730 supply electricity, more specifically, transfer bias, to the transfer rollers 74. Each of the transfer rollers 74 is provided with one of the spring electrodes 730, and the spring electrodes 730 as well as the transfer rollers 74 are arranged at equal intervals from one another to align along the front-rear direction. The first metal beam 510 is arranged in a position between two electrodes in midst positions along the front-rear direction among the four electrodes (e.g., the electrodes 710A for wires), which share the electricity from the same source.

Figure 13:
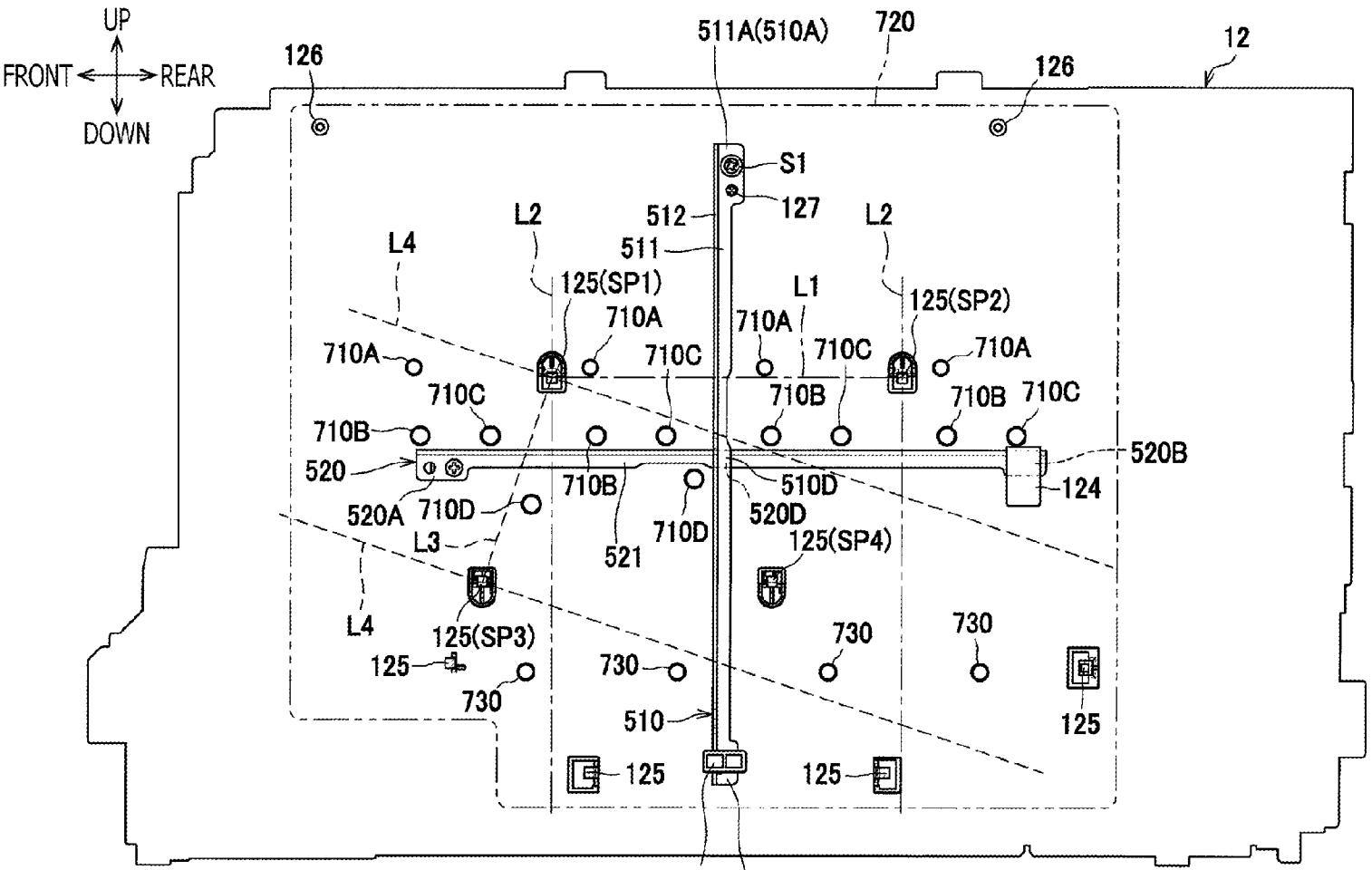
FIG. 13 is a diagram to illustrate arrangement of the first and second meal beams, substrate-supporting structures, and the spring electrodes in the color printer according to the embodiment of the present invention.

Next, arrangement of the first metal beam 510, the second metal beam 520, the plurality of substrate supports 125, 126, and the plurality of spring electrodes 710, 730 will be described in detail. As illustrated in FIG. 13, the substrate supports 125, 126 include upper supports SP1, SP2 and lower supports SP3, SP4. The upper supports SP1, SP2 are two of the substrate supports 125, 126, which are in positions closest to an upper edge of the second metal beam 520 among the substrate supports 125, 126. The lower supports SP3, SP4 are two of the substrate supports 125, 126, which are in positions closest to a lower edge of the second metal beam 520 among the substrate supports 125, 126.

The upper supports SP1, SP2 are arranged to be spaced apart from each other along the front-rear direction. In an intermediate area between the upper supports SP1, SP2, when viewed laterally along the widthwise direction, i.e., in the angle to face the planar lateral side of the right-side frame 12 orthogonally, some of the spring electrodes 710, 730 are arranged.

More specifically, while a first virtual line L1 is drawn through the upper supports SP1, SP2, in an intermediate area between two (2) second virtual lines L2, which are orthogonal to the first virtual line L1, two (2) electrodes 710A for wires, two (2) electrodes 710B for developers, two (2) electrodes 710C for grids, one (1) electrode 710D for drum, and two (2) spring electrodes 730 are interposed.

Figure 14:
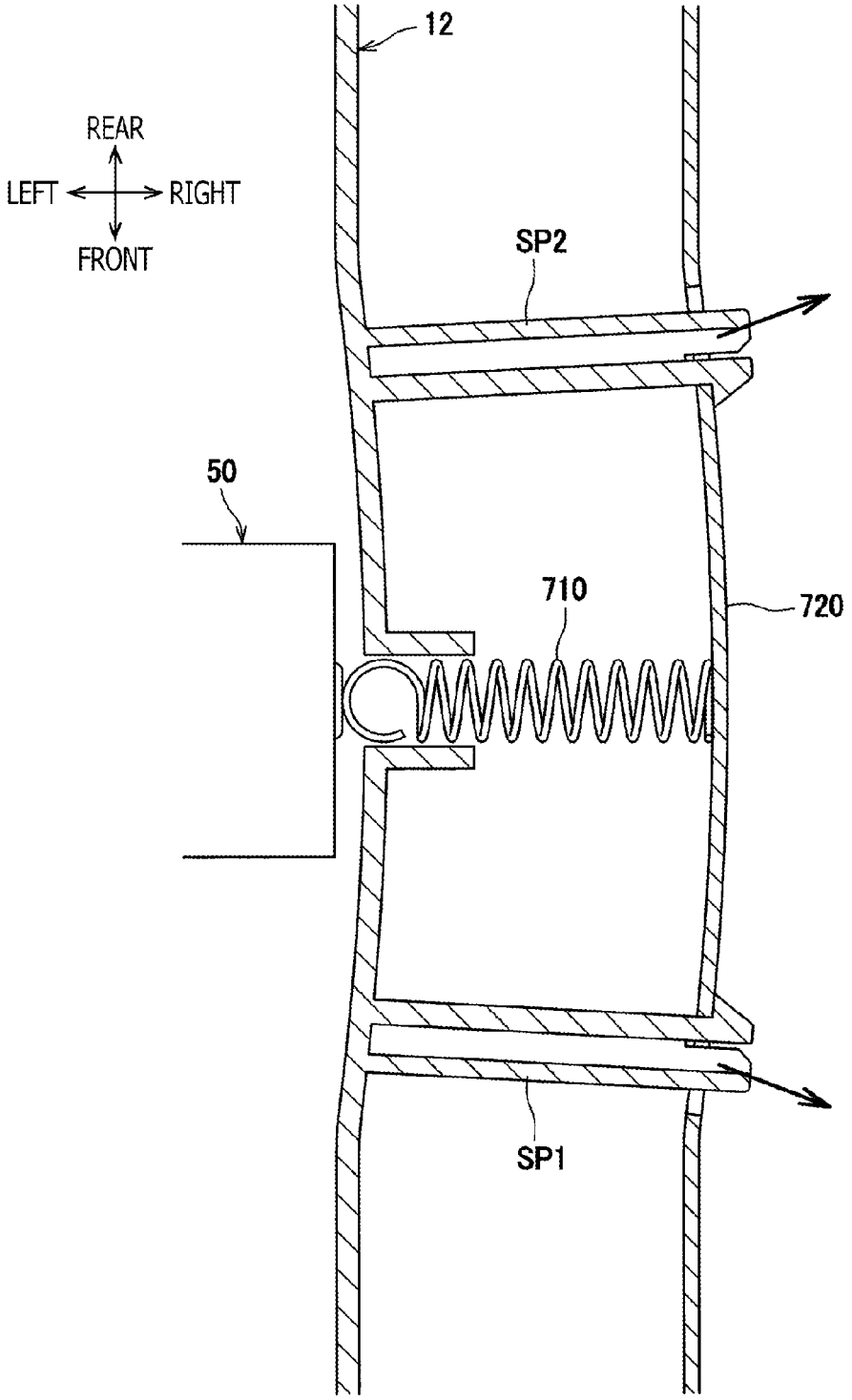
FIG. 14 is a diagram to illustrate creep-deformation of the right-side frame in the color printer according to the embodiment of the present invention.

Thus, with some of the spring electrodes 710, 730 arranged in the area between the second virtual lines L2, as shown in FIG. 14, the substrate 720 tends to be creep-deformed outwardly along the widthwise direction due to the resilient force from the some of the spring electrodes 710, 730. Meanwhile, the upper supports SP1, SP2 are subject to forces to draw the upper supports SP1, SP2 outwardly along the widthwise direction and along the front-rear direction, as indicated by thick arrows in FIG. 14. Accordingly, the area between the upper supports SP1, SP2 in the right-side frame 12 tends to be creep-deformed to expand outwardly along the widthwise direction.

In this regard, according to the present embodiment, the first metal beam 510 is arranged to cross over the first virtual line L1, when viewed laterally along the widthwise direction, and is fixed to the right-side frame 12 along the widthwise direction at the upper end portion 510A and the lower end portion 510B thereof.

With the arrangement of the first metal beam 510 to cross over the first virtual line L1, the creep-deformation of the portion in the right-side frame 12 between the upper supports SP1, SP2 due to the resiliency of the spring electrodes 710, 730 can be restrained by the first metal beam 510.

Meanwhile, the upper end portion 510A of the first metal beam 510 is arranged on the opposite side from a central part 510D of the first metal beam 510 across the first virtual line L1. In this regard, the spring electrodes 710 are arranged more densely in the areas proximity to the central part 510D while fewer spring electrodes 710 are arranged in an upper area above the first virtual line L1. Therefore, the upper area above the first virtual line L1 in the right-side frame 12 is more difficult to be deformed compared to the lower area with respect to the first virtual line L1. Thus, with the upper end portion 510A of the first metal beam 510 fixed to the upper area, which is more difficult to be deformed, the creep-deformation in the portion between the upper supports SP1, SP2 can be effectively restrained by the first metal beam 510.

The lower supports SP3, SP4 are arranged to be spaced apart from each other, with the first metal beam 510 interposed there-between, along the front-rear direction. The lower support SP3 is in a frontward position closer to the front end of the right-side frame 12 while the lower support SP4 is in a rearward position closer to the rear end of the right-side frame 12. Further, the lower support SP3 is in a frontward position with respect to the upper support SP1, which is closer to the front end of the right-side frame 12 with respect to the upper support SP2, and the lower support SP4 is in a rearward position with respect to the upper support SP 2.

The upper support SP1 and the lower support SP3 in the frontward positions are arranged in frontward positions with respect to the first metal beam 510, on one side with respect to the first metal beam 510 along a direction of shorter sides of the first metal beam 510 when viewed laterally along the widthwise direction, in spaced apart positions from each other along the vertical direction and along the front-rear direction. In an intermediate area between the upper support SP1 and the lower support SP3, when viewed laterally along the widthwise direction, some of the spring electrodes 710, 730 are arranged.

More specifically, while a third virtual line L3 is drawn through the upper support SP1 and the lower support SP3, in an intermediate area between two (2) fourth virtual lines L4, which are orthogonal to the third virtual line L3 and extend through the upper support SP1 and the lower support SP3 respectively, one (1) electrode 710A for wire, two (2) electrodes 710B for developers, two (2) electrodes 710C for grids, two (2) electrodes 710D for drums, and two (2) spring electrodes 730 are interposed.

Thus, with some of the spring electrodes 710, 730 arranged in the area between the fourth virtual lines LA, as shown in FIG. 14, the substrate 720 tends to be creep-deformed outwardly along the widthwise direction at the area between the upper support SP1 and the lower support SP3, similarly to the area between the upper supports SP1, SP2. In this regard, according to the present embodiment, the first metal beam 510 is formed to extend outwardly beyond the upper support SP1 and the SP3 along the vertical direction (i.e., the longitudinal direction). Therefore, the creep-deformation of the portion in the right-side frame 12 between the upper support SP1 and the lower support SP3 due to the resiliency of the some of the spring electrodes 710, 730 can be restrained by the first metal beam 510.

In this regard, the upper end portion 510A of the first metal beam 510 is placed in proximity to the upper end of the substrate 720. In the above and following description, the terms the upper and lower ends of the substrate 720 refer to an upper area and a lower area among vertically trisected areas in the substrate 720.

Further, the second metal beam 520 is arranged, when viewed laterally along the widthwise direction, to cross over the first metal beam 510 orthogonally, and the front end 520A and the rear end 520B of the second metal beam 520 are fixed to the right-side frame 12 at least along the widthwise direction. Thus, with the first and second metal beams 510, 520 arranged to intersect with each other, the creep-deformation of the right-side frame 12 can be more effectively restrained.

Meanwhile, the second metal beam 520 is, when viewed laterally along the widthwise direction, arranged to intersect with a fifth virtual line, which is coincident to the third virtual line L3. Therefore, with the second metal beam 520 intersecting with the third virtual line L3, the creep-deformation of the portion in the right-side frame 12 between the upper support SP1 and the lower support SP3 due to the resiliency of the some of the spring electrodes 710, 730 can be restrained by the first metal beam 510.

The front end 520A of the second metal beam 520 is arranged on the opposite side from a central part 520D of the second metal beam 520 across the third virtual line L3.

Meanwhile, the second metal beam 520 is placed in the position between the right-side frame 12 and the first metal beam 510 along the widthwise direction, and the central part 520D of the second metal beam 520 is placed to be in contact with the central part 510D of the first metal beam 510. In this regard, on an upper side with respect to the second metal beam 520, the electrodes 710B for developers and the electrodes 710C for grids are arranged in positions aligning along the front-rear direction, i.e., along the longitudinal direction of the second metal beam 520. With this arrangement, the creep-deformation of the right-side frame 12 due to the resilient force from the spring electrodes 710B, 710C aligned along the longitudinal direction of the second metal beam 520 can be effectively restrained. Meanwhile, with the second metal beam 520 being supported at the central part 520D by the central part 510D of the first metal beam 510, the creep-deformation of the right-side frame 12 at the central area can be effectively restrained. Further, while the force applied to the second metal beam 520 is borne by the central part 510D of the first metal beam 510 via the central part 520D of the second metal beam 520, when, for example, the right-side frame 12 is subject to a force along the widthwise direction, the force can be borne by the first and second metal beams 510, 520 effectively.

According to the present embodiment, when viewed laterally along the widthwise direction the first metal beam 510, one of the electrodes 710A for wires arranged on a third place from the front, and the upper support SP2 on the rearward position are arranged in an order mentioned above, i.e., the first metal beam 510, the electrode 710A, and the upper support SP2, with respect to a rearward direction from the front toward the rear. Meanwhile, when viewed along the widthwise direction, one of the two electrodes 710D for drums in a rearward position, the first metal beam 510, and the lower support SP4 on the rearward position are arranged in an order mentioned above, i.e., the electrode 710D, the first metal beam 510, and the lower support SP4, along the direction front toward the rear.

In this regard, a distance between the electrode 710D for drum in the rearward position, which is a spring electrode in a position closest the first metal beam 510 among the spring electrodes 710, 730, and the first metal beam 510 along the front-rear direction is approximately ½ of a distance between the first metal beam 510 and the rearward lower support SP4 along the front-rear direction. Further, lengths of the first metal beam 510 and the second metal beam 520 in the longitudinal direction are at least twice and at most 100 times, preferably between 10 times and 80 times, as long as the largest parts of shorter sides of the first metal beam 510 and the second metal beam 520.

Meanwhile, each of loads to be applied to the right-side frame 12 from the spring electrodes 710, 730 should be 1.47N, and a total quantity of the spring electrodes 710 to apply the resilient force to the drawer 60 or the processing units 50 is fourteen (14).

According to the embodiment described above, additionally to the effects having been mentioned above, while the first and second metal beams 510, 520 have the first section 511 and the first section 521, which overlap each other along the widthwise direction, the first and second metal beams 510, 520 are stably attached to the right-side frame 12 via the first section 511 and the first section 521. Further, with the first sections 511, 521 of the first and second metal beams 510, 520, the rigidity of the metal beams 510, 520 can be increased.

Although an example of carrying out the invention has been described, those skilled in the art will appreciate that there are numerous variations and permutations of the color printer that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, forms of the first and second metal beams 510, 520 may not necessarily be limited to the bent-formed thin bars but may be, for example, prismatic metal bars as long as the first and second metal beams are in elongated shapes. For another example, the first or second metal beams may be formed to have a cross section of a circle or a polygon, which can be either hollow or solid. In this regard, however, compared to a color printer having the prismatic metal bars for example, the bent-formed thin bars may be effective to reduce the weight of the color printer.

For another example, arrangement of the first and second metal beams 510, 520 may not necessarily be limited to the arrangement described above. For example, the first and second metal beams 510, 520 may be arranged in a position between any two electrodes, which share the electricity from the same electric source. In this regard, it may be preferable that a clearance between the two electrodes adjoining the metal beam is larger than other clearances between the other non-adjoining electrodes.

For another example, the spring electrodes 710, 730 may not necessarily include the compressed coiled springs but may include, for example, blade springs or torsion springs.

For another example, the developer cartridge 53 may not necessarily be configured to include the developer roller 54 and the toner container 56 but may include a developer device containing the rollers alone, and the toner container 56 may be replaced with an exchangeable toner cartridge.

For another example, the processing units 50 supported by the drawer 60 may be removable from the drawer 60. For another example, a part of each processing unit 50, such as the developer cartridge 53, may be removable from the drawer 60. For another example, the photosensitive drums 51 may be integral with the drawer 60 to be supported by the drawer 60.

For another example, the embodiment described above may not necessarily be applied to a color printer but may be employed in, for example, a monochrome printer, a copier, or a multifunction peripheral device. For another example, a form of the L-shaped metal pieces 300 may not necessarily be limited to the metal sheets as long as the L-shaped metal piece is in the elongated shape. For example, the L-shaped metal piece may be formed to have a cross section of a circle or a polygon, which can be either hollow or solid.

For another example, the first and second metal beams 510, 520 may not be necessarily be fixed to the right-side frame 12 at the longitudinal both ends thereof but may be fixed along the widthwise direction to the right-side frame 12 at one longitudinal end thereof. In this regard, however, with the longitudinal both ends being fixed to the right-side frame 12, the creep-deformation of the right-side frame 12 may be restricted more effectively.

Figure 15A:
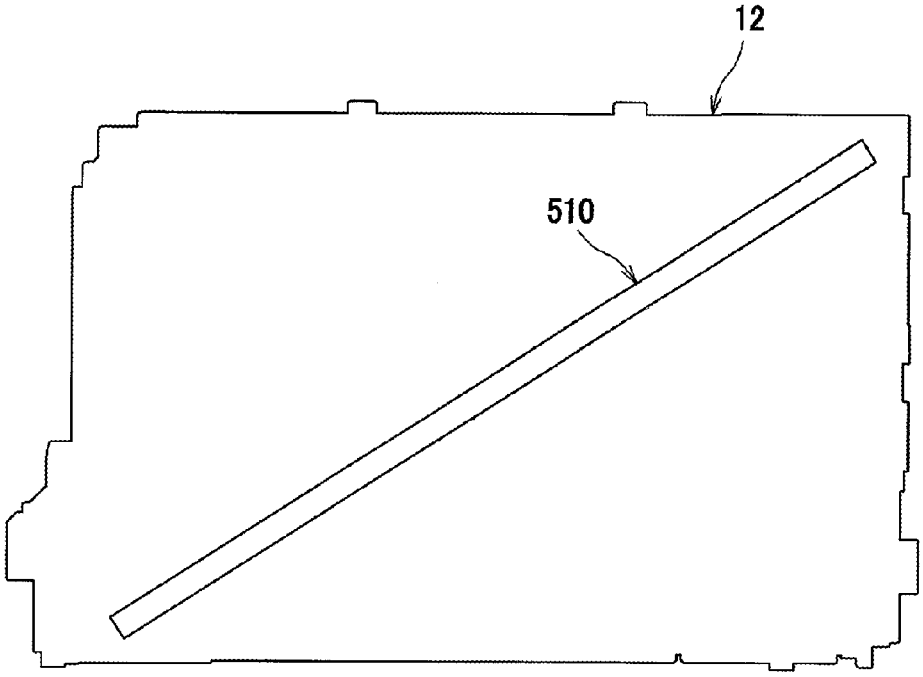
FIG. 15A is an example of arrangement of the first metal beam in the color printer according to the embodiment of the present invention.

For another example, the first metal beam 510 may not necessarily be arranged longitudinally along the vertical direction. For example, as illustrated in FIG. 15A, the first metal beam 510 may be arranged in an oblique orientation with respect to the vertical direction, for example, along a diagonal line of the right-side frame 12. For another example, as shown in FIG. 15A, the second metal beam 520 may be omitted.

Figure 15B:
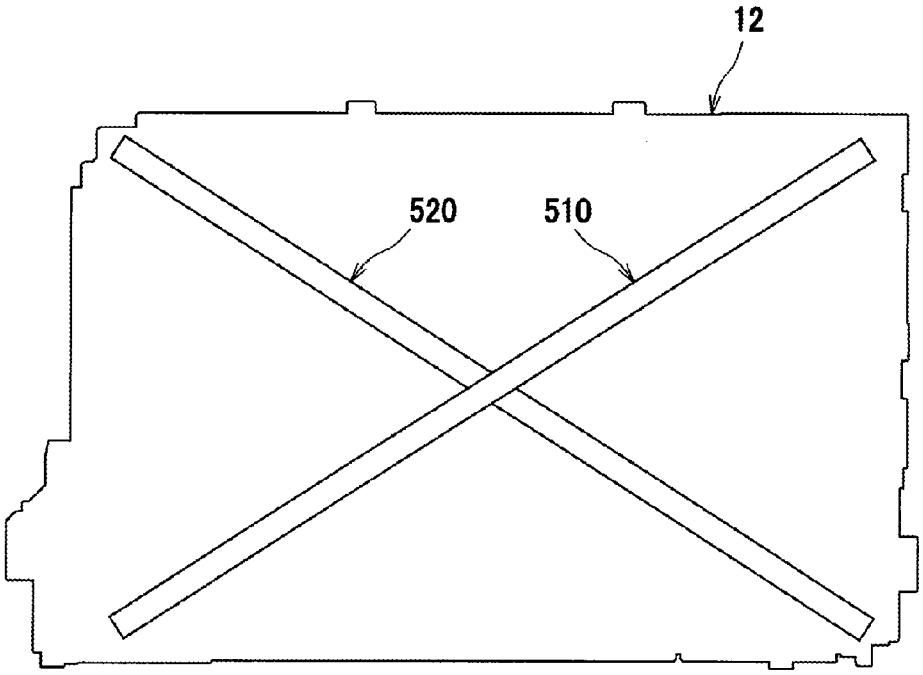
FIG. 15B is an example of arrangement of the first and second metal beams in the color printer according to the embodiment of the present invention.

For another example, as shown in FIG. 15B, the first and second metal beams 510, 520 may be placed in a form of an "X." More specifically, the first metal beam 510 may be arranged in the oblique orientation with respect to the vertical direction along a first diagonal line of the right-side frame 12 while the second metal beam 520 may be arranged in an another oblique orientation along a second diagonal line which is different from the first diagonal line.

What is claimed is:

1. An image forming apparatus, comprising:

an image forming unit comprising a photosensitive drum configured to be rotatable about a rotation axis and a developer device configured to supply a developer agent to the photosensitive drum;

a first frame made of a resin and formed in a shape of a plate, the first frame being arranged on one end, along an axial direction of the rotation axis of the photosensitive drum, of the image forming unit;

a first beam made of a metal and formed in an elongated shape, the first beam being arranged along and fixed to a planar face of the first frame, and the first beam being arranged to overlap the image forming unit at a longitudinal central part thereof, when projected along the axial direction, while longitudinal ends of the first beam are arranged on outer sides of the image forming unit; and a second beam formed in an elongated shape, the second beam being arranged along and fixed to the planar face of the first frame to intersect with the first beam, and the second beam being in contact with the longitudinal central part of the first beam at a longitudinal central part thereof.

2. The image forming apparatus according to claim 1, wherein the image forming unit comprises a plurality of image forming units, the plurality of image forming units being arranged to align along an aligning direction, which is orthogonal to the rotation axis;

wherein the first beam is arranged to longitudinally extend orthogonally to the aligning direction and to the axial direction; and wherein the second beam is arranged to longitudinally extend along the aligning direction.

3. The image forming apparatus according to claim 2, further comprising:

a drawer configured to support the plurality of image forming units, the drawer being supported by the first frame movably to move along the aligning direction, wherein the second beam is arranged to overlap the drawer when projected along the axial direction.

4. The image forming apparatus according to claim 1, wherein the first beam is formed of a metal bar having a first section, which spreads orthogonally to the axial direction, and a second section, which spreads from the first section along the axial direction.

5. The image forming apparatus according to claim 1, further comprising:

a second frame arranged on another end of the image forming unit to face the first frame across the image forming unit; and a connecting frame configured to be connected to the first frame and the second frame, wherein one of the longitudinal ends of the first beam is arranged to overlap the connecting frame when projected along the axial direction.

6. The image forming apparatus according to claim 5, wherein the other one of the longitudinal ends of the first beam is engaged with the first frame; and wherein the second beam is arranged in a position between the first beam and the first frame.

7. The image forming apparatus according to claim 1, wherein a spring electrode to supply electricity to the image forming unit is arranged on the first frame; and wherein the spring electrode is arranged in a position between the first frame and the image forming unit in a compressed condition.

8. The image forming apparatus according to claim 1, wherein the first frame comprises a plurality of substrate supports, which are configured to support a substrate, the substrate being configured to supply electricity to the image forming unit via a spring electrode, and wherein the spring electrode is arranged in a position between the substrate and the image forming unit in a compressed condition.

9. The image forming apparatus according to claim 8, wherein the plurality of substrate supports are arranged on an opposite side from the image forming unit across the first frame; and wherein the first frame comprises a through hole, in which the spring electrode is arranged to penetrate therethrough.

10. An image forming apparatus, comprising:

an image forming unit comprising a photosensitive drum configured to be rotatable about a rotation axis;

a first frame made of a resin and arranged on one end, along an axial direction of the rotation axis of the photosensitive drum, of the image forming unit;

a substrate arranged on one side of the first frame opposite from the image forming unit;

a plurality of substrate supports arranged on the first frame and configured to support the substrate, the plurality of substrate supports comprising paired first supports, which are arranged to be spaced apart from each other;

a plurality of spring electrodes, each of which is arranged in a position between the substrate and the image forming unit in a compressed condition;

a first beam formed in an elongated shape having a shorter side and a longer side, the first beam being arranged along and fixed to a planar face on the one side of the first frame facing the substrate; and a second beam formed in an elongated shape, the second beam being arranged along and fixed to the planar face of the first frame to intersect with the first beam when viewed along a facing direction to face the planar face of the first frame orthogonally, and the second beam being in contact with a longitudinal central part of the first beam at a longitudinal central part thereof, wherein, while a first virtual line is drawn through the paired first supports, a first intermediate spring electrode being a part of the plurality of spring electrodes is arranged in an intermediate area between two second virtual lines, each of which is drawn through one of the paired first supports orthogonally to the first virtual line when viewed along the facing direction and wherein the first beam comprises a first attachment portion, at which the first beam is fixed to the first frame at least along the facing direction, and is arranged to intersect with the first virtual line when viewed along the facing direction.

11. The image forming apparatus according to claim 10, wherein the first attachment portion is arranged on an opposite side from the longitudinal central part of the first beam across the first virtual line.

12. The image forming apparatus according to claim 10, wherein the plurality of substrate supports comprise paired second supports, which are arranged to be spaced apart from each other at least along a longitudinal direction of the first beam;

wherein, while a third virtual line is drawn through the paired second supports, a second intervening spring electrode being a part of the plurality of spring electrodes is arranged in an intermediate area between two fourth virtual lines, each of which is drawn through one of the paired second supports orthogonally to the third virtual line when viewed along the facing direction; and wherein the first beam is formed to extend outwardly along the longitudinal direction thereof beyond the paired second supports.

13. The image forming apparatus according to claim 12, wherein the first attachment portion of the first beam is formed on one of longitudinal ends of the first beam; and wherein the first beam comprises a second attachment portion, at which the first beam is fixed to the first frame at least along the facing direction, on the other one of the longitudinal ends of the first beam.

14. The image forming apparatus according to claim 13, wherein the plurality of substrate supports comprise paired third supports, which are arranged on one side with respect to the first beam along a direction of the shorter side of the first beam in positions spaced apart from each other at least along the longitudinal direction of the first beam;

wherein, while a fifth virtual line is drawn through the paired third supports, a third intermediate spring electrode being a part of the plurality of spring electrodes is arranged in an intermediate area between two sixth virtual lines, each of which is drawn through one of the paired third supports orthogonally to the fifth virtual line when viewed along the facing direction; and wherein the second beam comprises a third attachment portion, at which the second beam is fixed to the first frame at least along the facing direction, and is arranged to intersect with the fifth virtual line when viewed along the facing direction.

15. The image forming apparatus according to claim 14, wherein the third attachment portion is arranged on an opposite side from a longitudinal central part of the second beam across the fifth virtual line.

16. The image forming apparatus according to claim 10, wherein at least some of the plurality of spring electrodes are arranged in positions aligning along a longitudinal direction of the second beam; and wherein the second beam is arranged in a position between the first beam and the first frame.

17. The image forming apparatus according to claim 10, wherein the image forming unit comprises a plurality of image forming units, the plurality of image forming units being arranged to align along an aligning direction, which is orthogonal to the rotation axis;

wherein the first beam is arranged to longitudinally extend orthogonally to the aligning direction and to the axial direction; and wherein the second beam is arranged to longitudinally extend along the aligning direction.

18. The image forming apparatus according to claim 10, wherein the first attachment portion is placed in proximity to an upper end of the substrate.

19. The image forming apparatus according to claim 10, wherein the first beam is made of a metal.

20. An image forming apparatus, comprising:

an image forming unit comprising a photosensitive drum configured to be rotatable about a rotation axis;

a first frame made of a resin and arranged on one end, along an axial direction of the rotation axis of the photosensitive drum, of the image forming unit;

a substrate arranged to face the image forming unit;

a plurality of substrate supports arranged on the first frame and configured to support the substrate;

a plurality of spring electrodes arranged in positions between the substrate and the image forming unit;

a first beam formed in an elongated shape, the first beam being arranged along and fixed to a planar face of the first frame; and a second beam formed in an elongated shape, the second beam being arranged along and fixed to the planar face of the first frame to intersect with the first beam, and the second beam being in contact with a longitudinal central part of the first beam at a longitudinal central part thereof, wherein, when viewed along a direction orthogonal to the planar face of the first frame, the first beam, at least one of the spring electrodes, and at least one of the substrate supports are arranged to align along a direction orthogonal to a longitudinal direction of the first beam in an order: the first beam, the at least one of the spring electrodes, and the at least one of the substrate supports.

21. The image forming apparatus according to claim 20, wherein, when viewed along the direction orthogonal to the planar face of the first frame, the first beam, at least another one of the spring electrodes, and at least another one of the substrate supports are arranged to align along the direction orthogonal to the longitudinal direction of the first beam in an order: the at least another one of the spring electrodes, the first beam, and the at least another one of the substrate supports.

22. The image forming apparatus according to claim 20, wherein the first beam is arranged to overlap the image forming unit at the longitudinal central part thereof, when projected along the axial direction, while longitudinal ends of the first beam are arranged on outer sides of the image forming unit.

23. The image forming apparatus according to claim 20, wherein the image forming unit comprises a plurality of image forming units, the plurality of image forming units being arranged to align along an aligning direction, which is orthogonal to the rotation axis;

wherein the first beam is arranged to longitudinally extend orthogonally to the aligning direction and to the axial direction; and wherein the second beam is arranged to longitudinally extend along the aligning direction.

24. The image forming apparatus according to claim 23, further comprising:

a drawer configured to support the plurality of image forming units, the drawer being supported by the first frame movably to move along the aligning direction, wherein the second beam is arranged to overlap the drawer when projected along the axial direction.

25. The image forming apparatus according to claim 20, wherein the first beam is made of a metal.

26. The image forming apparatus according to claim 25, wherein the first beam is formed of a metal bar having a first section, which spreads orthogonally to the axial direction, and a second section, which spreads from the first section along the axial direction.

27. The image forming apparatus according to claim 20, further comprising:

a second frame arranged on another end of the image forming unit to face the first frame across the image forming unit; and a connecting frame configured to be connected to the first frame and the second frame, wherein one of longitudinal ends of the first beam is arranged to overlap the connecting frame when projected along the axial direction.

28. The image forming apparatus according to claim 27, wherein the other one of the longitudinal ends of the first beam is engaged with the first frame; and wherein the second beam is arranged in a position between the first beam and the first frame.

29. The image forming apparatus according to claim 20, wherein the plurality of substrate supports are arranged on an opposite side from the image forming unit across the first frame; and wherein the first frame comprises through holes, in each of which one of the spring electrodes is arranged to penetrate there-through.

30. An image forming apparatus, comprising:

an image forming unit comprising a photosensitive drum configured to be rotatable about a rotation axis;

a first frame made of a resin and arranged on one end, along an axial direction of the rotation axis of the photosensitive drum, of the image forming unit;

a substrate arranged on one side of the first frame opposite from the image forming unit;

a plurality of substrate supports arranged on the first frame and configured to support the substrate;

a plurality of spring electrodes, each of which is arranged in a position between the substrate and the image forming unit in a compressed condition;

a first beam formed in an elongated shape having a shorter side and a longer side, the first beam being arranged along and fixed to a planar face on the one side of the first frame facing the substrate; and a second beam formed in an elongated shape, the second beam being arranged along and fixed to the planar face of the first frame to intersect with the first beam when viewed along a facing direction to face the planar face of the first frame orthogonally, and the second beam being in contact with a longitudinal central part of the first beam at a longitudinal central part thereof;

wherein the plurality of substrate supports comprise paired substrate supports, which are arranged to be spaced apart from each other at least along a longitudinal direction of the first beam;

wherein, while a first virtual line is drawn through the paired substrate supports, an intervening spring electrode being a part of the plurality of spring electrodes is arranged in an intermediate area between two second virtual lines, each of which is drawn through one of the paired substrate supports orthogonally to the first virtual line when viewed along the facing direction; and wherein the first beam is formed to extend outwardly along the longitudinal direction thereof beyond the paired substrate supports.

31. An image forming apparatus, comprising:

an image forming unit comprising a photosensitive drum configured to be rotatable about a rotation axis;

a first frame made of a resin and arranged on one end, along an axial direction of the rotation axis of the photosensitive drum, of the image forming unit;

a substrate arranged to face the image forming unit;

a substrate support arranged on the first frame and configured to support the substrate;

a spring electrode arranged in a position between the substrate and the image forming unit;

a first beam formed in an elongated shape, the first beam being arranged along and fixed to a planar face of the first frame; and a second beam formed in an elongated shape, the second beam being arranged along and fixed to the planar face of the first frame to intersect with the first beam, and the second beam being in contact with a longitudinal central part of the first beam at a longitudinal central part thereof, wherein, when viewed along a direction orthogonal to the planar face of the first frame, the first beam, the spring electrode, and the substrate support are arranged to align along a direction orthogonal to a longitudinal direction of the first beam in an order: the spring electrode, the first beam, and the substrate support.

* * * * *